US011534003B2

(12) United States Patent
DeVries et al.

(10) Patent No.: US 11,534,003 B2
(45) Date of Patent: Dec. 27, 2022

(54) CHAIR GANGER WITH INTERPERSONAL SHIELD

(71) Applicant: Exemplis LLC, Cypress, CA (US)

(72) Inventors: Paul DeVries, Huntington Beach, CA (US); Peter Yee, Irvine, CA (US); Daniel Chae, Mission Viejo, CA (US)

(73) Assignee: Exemplis LLC, Cypress, CA (US)

( * ) Notice: Subject to any disclaimer, the term of this patent is extended or adjusted under 35 U.S.C. 154(b) by 0 days.

(21) Appl. No.: 17/390,065

(22) Filed: Jul. 30, 2021

(65) Prior Publication Data

US 2022/0151390 A1 May 19, 2022

Related U.S. Application Data

(60) Provisional application No. 63/068,857, filed on Aug. 21, 2020.

(51) Int. Cl.

| | |
|---|---|
| ***A47C 1/124*** | (2006.01) |
| ***A47C 11/00*** | (2006.01) |
| ***A47C 7/62*** | (2006.01) |

(52) U.S. Cl.

CPC ..... *A47C 11/005* (2013.01); *A47C 1/124* (2013.01); *A47C 7/62* (2013.01)

(58) Field of Classification Search

CPC ..... A47C 1/124; A47C 11/005; A47C 7/62; A47B 2200/12; E06B 9/00; B64D 11/0606

See application file for complete search history.

(56) References Cited

U.S. PATENT DOCUMENTS

| | | | | |
|---|---|---|---|---|
| 3,188,138 | A | 6/1965 | Lockshin | |
| 3,237,984 | A | 3/1966 | Schneider et al. | |
| 3,314,718 | A | 4/1967 | Crandall | |
| 3,594,038 | A | 7/1971 | Chang et al. | |
| 3,614,157 | A | 10/1971 | Hendrickson et al. | |
| 3,638,997 | A | 2/1972 | Shapiro et al. | |
| 3,640,569 | A | 2/1972 | Young | |
| 3,695,694 | A | 10/1972 | Mohr | |
| 3,697,130 | A | 10/1972 | Barecki et al. | |
| 3,758,155 | A | 9/1973 | Straits | |
| 4,386,804 | A | 6/1983 | Ware et al. | |
| 5,282,669 | A | 2/1994 | Barile | |
| 5,954,396 | A | 9/1999 | Kemnitzer | |
| 6,338,528 | B1 | 1/2002 | Lohness et al. | |
| 6,406,094 | B2 | 6/2002 | Lohness et al. | |
| 6,749,259 | B2 | 6/2004 | Ware et al. | |
| 7,017,990 | B2 | 3/2006 | Mendenhall et al. | |
| 9,756,946 | B2 * | 9/2017 | Chang | A47C 7/546 |
| 9,826,832 | B2 | 11/2017 | Lin | |
| 10,349,746 | B2 * | 7/2019 | Koehler | A47C 7/16 |
| 11,179,287 | B1 * | 11/2021 | Mirbahaeddin | A61B 90/05 |

(Continued)

FOREIGN PATENT DOCUMENTS

| | | | | |
|---|---|---|---|---|
| EP | 3560425 | A1 * | 10/2019 | A47C 3/18 |
| EP | E P-3954610 | A1 * | 2/2022 | B64D 11/0606 |

(Continued)

*Primary Examiner* — Timothy J Brindley

(74) *Attorney, Agent, or Firm* — Knobbe Martens Olson & Bear LLP

(57) ABSTRACT

A chair ganging assembly can include a chair ganger bracket connecting two chairs together and an interpersonal shield for supporting an interpersonal shield between two chairs that are ganged together.

23 Claims, 20 Drawing Sheets

(56) References Cited

U.S. PATENT DOCUMENTS

| | | | | |
|---|---|---|---|---|
| 11,299,274 | B1 * | 4/2022 | Davis | B64D 11/0644 |
| 2001/0045502 | A1 | 11/2001 | Lohness et al. | |
| 2003/0201661 | A1 | 10/2003 | Ware et al. | |
| 2014/0116632 | A1 * | 5/2014 | Domash | A47C 7/72 160/369 |
| 2015/0084393 | A1 | 3/2015 | Chang et al. | |
| 2017/0164752 | A1 * | 6/2017 | Partridge | A47C 1/16 |
| 2021/0380256 | A1 * | 12/2021 | Wisniewski | B64D 11/0606 |
| 2022/0063812 | A1 * | 3/2022 | Ryan | B64D 11/0606 |
| 2022/0081118 | A1 * | 3/2022 | Kodati | B64D 11/0606 |
| 2022/0125207 | A1 * | 4/2022 | Lerner | A47C 7/62 |

FOREIGN PATENT DOCUMENTS

| | | | | | |
|---|---|---|---|---|---|
| EP | E P-3981664 | A1 * | 4/2022 | | |
| EP | E P-4001582 | A1 * | 5/2022 | | B64D 11/0606 |
| FR | 3111780 | A1 * | 12/2021 | | |
| FR | 3115740 | A1 * | 5/2022 | | |
| KR | 20220001592 | U * | 7/2022 | | |
| WO | WO-2021262215 | A1 * | 12/2021 | | |
| WO | WO-2022045265 | A1 * | 3/2022 | | |

* cited by examiner

CHAIR GANGER WITH INTERPERSONAL SHIELD

INCORPORATION BY REFERENCE TO ANY PRIORITY APPLICATIONS

This application claims the benefit of U.S. Patent Provisional Application No. 63/068,857, filed Aug. 21, 2020, the entire contents of which are hereby expressly incorporated by reference herein in their entirety and for all purposes. In addition, any and all applications for which a foreign or domestic priority claim is identified in the Application Data Sheet as filed with the present application are hereby incorporated by reference under 37 CFR 1.57.

BACKGROUND OF THE INVENTIONS

Field of the Inventions

The embodiments disclosed herein relate to interpersonal shields designed for reducing transmission of disease between humans, including shields integrated with chair connectors used for ganging a plurality of chairs together.

Description of the Related Art

In various types of venues including concert halls or stadiums foldable, stackable, or other types of chairs are often arranged in rows (individual chairs) for providing seating for an audience. Similar chairs are often used in waiting rooms, large and small alike.

In some applications, such independent chairs can be securely connected together or "ganged" so as to affix a plurality of chairs in a series with little or no space between the chairs.

SUMMARY OF THE INVENTIONS

An aspect of at least one of the inventions disclosed herein includes the realization that independent chairs that are ganged to together may result in a spacing that may be non-optimal or inappropriate during times of elevated risk of transmission of airborne diseases, for example, between users of adjacent chairs during a pandemic.

An aspect of at least one of the inventions disclosed herein includes the realization that a chair ganging bracket assembly can include an interpersonal shield designed to form an obstruction to the flow of exhaled gases between users of adjacent, ganged chairs. For example, a ganging bracket can support an interpersonal shield in an upright orientation in a position between two chairs, so as to interfere with a flow of exhaled gases from one user to another.

In some embodiments, the interpersonal shield can be transparent so as to preserve a feeling of openness. Additionally, in some embodiments, the interpersonal shield does not extend all the way to the floor or completely surround each chair. Rather, in some embodiments, the interpersonal shield is suspended above the ground and spaced from each chair such that there is enhanced airflow for the user.

By positioning the interpersonal shield directly between respiratory orifices of two users of adjacent chairs, a directed jet of exhaled gases from one user towards another would be impeded or diverted by the interpersonal shield. This can provide additional protection were one user to direct their respiratory orifices, e.g., their mouth or nose, towards a user of an adjacent chair and speak, sing, cough, or sneeze while facing the other user. As such, the interpersonal shield can provide a beneficial obstruction against such a direct flow of exhaled gases from one user towards the other.

Additionally, the ganger bracket can be sized so as to affix adjacent chairs at a spaced apart configuration, for example, at least six inches. In some embodiments, the ganger bracket spaces the sides of adjacent chairs by eight inches, ten inches, 12 inches or more.

Additionally, by positioning at least a part of the interpersonal shield above or on top of the ganger bracket, the ganger bracket is an inappropriate or uncomfortable structure for another user to sit on. Thus, it would be unlikely for a would-be third user to attempt to sit on the ganger bracket and thereby defeat the purpose of the physical spacing provided by the ganger bracket and interpersonal shield which can be an important issue during a period of an enhanced risk of disease transmissibility, such as a global pandemic.

Another aspect of at least one of the inventions disclosed herein includes a realization that a ganger bracket that is designed to connect portions of adjacent chairs near the seating surface can have an interpersonal shield that extends upwardly, higher than the seating surface by at least about two feet, which would be roughly a sufficient distance to create a barrier directly between the respiratory orifices of two average adult size humans sitting in adjacent, ganged chairs.

Another aspect of at least one of the embodiments disclosed herein includes a realization that a chair ganging device can include an interpersonal shield that includes a rear edge that extends rearwardly at least as far as a backrest surface of a chair and a forward edge that extends at least about 12 inches forward of the backrest seating surface. As such, the interpersonal shield would provide a barrier directly between the respiratory orifices of two users sitting in adjacent, ganged chairs.

Another aspect of at least one of the inventions disclosed herein includes the realization that connecting chairs together with the ganger bracket which engages the front and rear legs of adjacent chairs, wherein the front legs of the chairs are not parallel with the rear legs of the chairs provides a significant anti-racking benefit. For example, the ganger bracket that secures two adjacent chairs together with or add a spacing that is greater than 1 or 2", can be subjected to significant torque when one chair is pushed either forward rear ward relative to the connected chair. This is known as a racking movement, and can subject the end connectors of a ganging bracket to high torque and thus can overcome the connecting strength of the ends of the bracket. The longer the ganger bracket, the higher the torque.

An aspect of at least one of the embodiments disclosed herein includes the realization that by connecting the ganger bracket to both the front and rear legs of adjacent chairs, where the front legs are not parallel to the rear legs, the racking movement of the chairs is resisted due to the out of alignment orientation of the front legs and the rear legs. Thus, less torque is applied directly to the connector, some of the load created by the racking forces being absorbed by the ganging bracket as a torsional load.

For example, in some embodiments, a ganging bracket can have collar type connectors for connecting together the front legs of two adjacent chairs and a second set of collar type connectors for connecting together the rear legs of two adjacent chairs. In some embodiments, the front and rear legs of the chairs have a round cross section, formed by rod or pipe. In such a configuration, the collar may be sized for a tight fit with the legs and/or can include a clamp for constricting the collar so as to form a tight connection with the chair legs. Such embodiments can be considered as comprising constrictable collar portions. Were the front and rear legs of the chairs parallel, a racking force would impart a direct torque between the collar and the chair legs, increasing the potential that the collar could slip and the chairs could be pushed into, then stuck in a racked position, and thus moving the chairs closer together. However, because the front and rear legs of the chairs are not parallel, a racking force would load the ganging bracket in torsion and thus the rigidity of the connection between the collars and the legs is less important for resisting an undesirable racking movement.

DETAILED DESCRIPTION OF EMBODIMENTS

Figure 1:
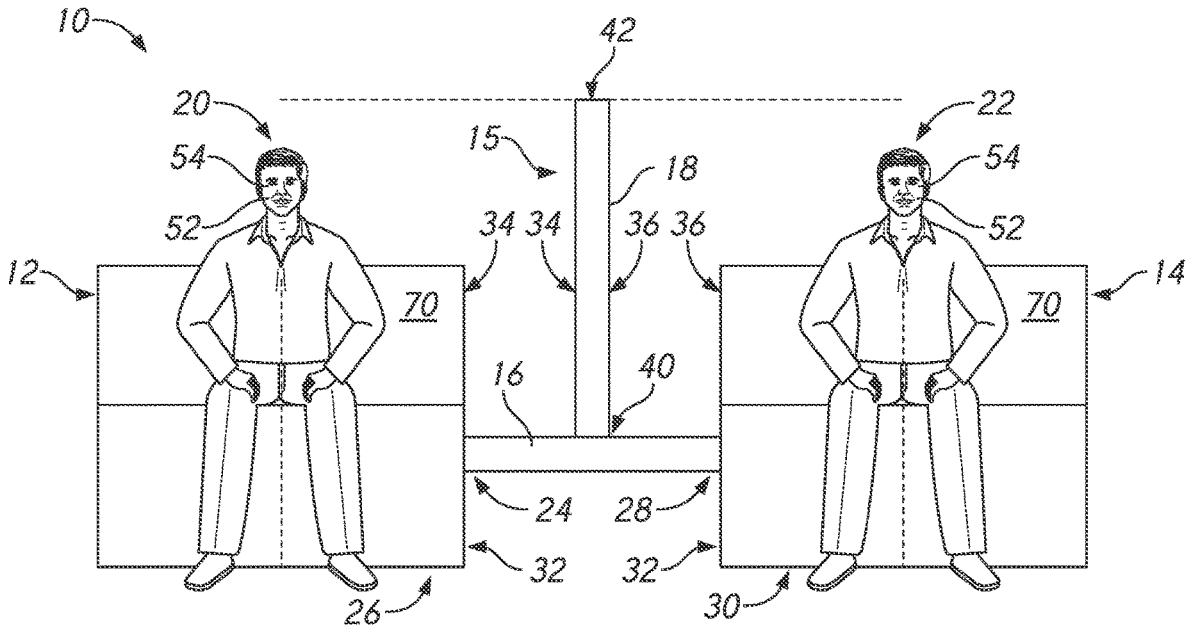
FIG. 1 is a schematic front elevational view of a ganged chair assembly with an integrated interpersonal shield.

The embodiments disclosed herein are described in the context of devices for connecting together chairs because the inventions disclosed herein have particular utility in that context. Inventions disclosed herein, however, can be used in other contexts as well, for example, but without limitation, for connecting interpersonal shields to the ends of pieces of furniture, without connection to other pieces of furniture, or connections to other devices that may be non-stationary, wheeled, or other types of devices.

Certain terms may be used in the following description for the purpose of reference only, and thus are not intended to be limiting. For example, terms such as "upper", "lower", "above", and "below" refer to directions in the drawings to which reference is made. Terms such as "front", "back", "rear", and "side" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

FIG. 1 is a schematic front elevational view of a ganged chair assembly with an integrated interpersonal shield, identified generally by the reference numeral 10. The ganged chair assembly 10 includes a first chair 12, a second chair 14, a ganger bracket and shield assembly 15 which can include a ganger bracket 16, and an interpersonal shield 18. A first user 20 is seated in the chair 12 and a second user 22 is seated in the second chair 14. Additional ganger bracket and shield assemblies 15 can be used to connect additional chairs (not show) to create a larger set, series, or row of ganged chairs with interpersonal shields 18 disposed therebetween.

The first and second chairs, 12, 14, are affixed relative to one another with the ganger bracket 16. For example, the ganger bracket 16 can have a first end portion 24 attached to a left side 26 of the first chair 12. Additionally, the ganger bracket 16 can have a second end 28 attached to a right side 30 of the second chair 14. The length of the ganger bracket 16 determines a spacing 32 between the left and right sides 26, 30 of the first and second chairs 12, 14, respectively.

The magnitude of the spacing 32 can be sized to provide a desired physical spacing between users, such as the users 20, 22 seated in adjacent first and second chairs 12, 14. For example, the bracket 16 can be sized to provide a spacing 32 that is at least about six inches. This is generally larger than some known chair ganging configurations because any spacing reduces the ultimate seating density or seating efficiency of a ganged chair arrangement within a defines space. However, larger spacings can help provide an improved physical spacing of users 20, 22 as well as some spacing between the users and the interpersonal shield 18. For example, the spacing 32 can be about 2 or more inches, 3 or more inches, 4 or more inches, 5 or more inches, more than 7 or more inches, 12 or more inches or other spacings.

For example, an interpersonal shield 18 usable with the embodiments disclosed herein can be relatively thin, e.g., generally less than one inch thick. Thus, a spacing 30, 32 of six inches or more can provide spacings 34, 36 that can provide optional additional benefits. For example, the spacing 34 can be disposed between the left side 26 of the chair 12 and the right side of the interpersonal shield 18. Additionally, the spacing 32 can provide a spacing 36 between the right side of the chair 14 and the left side of the interpersonal shield 18. Providing a spacing, such as the spacings 34, 36 between the chairs 12, 14 and the interpersonal shield 18, can help reduce the occurrence of physical contact between the users 12, 14 and the interpersonal shields 18, thereby reducing contamination of the side surfaces of the interpersonal shield 18. Additionally, spacing 34, 36 between the chairs 12, 14, and the interpersonal shield 18 can provide for additional airflow and a feeling of openness for users 20, 22.

Figure 2:
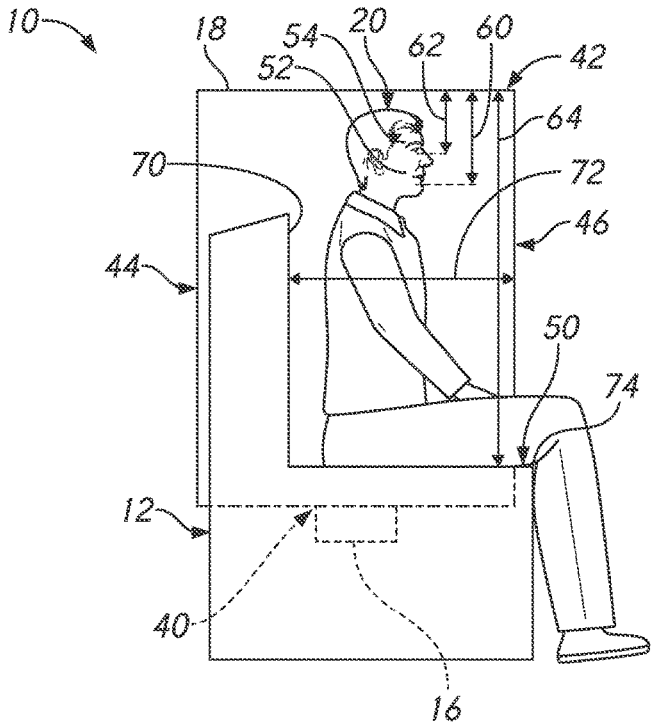
FIG. 2 is a side elevational view of the embodiment of FIG. 1.

With reference to FIG. 2, the interpersonal shield can have a lower end portion 40, an upper end portion 42, a rear edge portion 44, and a front edge portion 46.

The lower end portion 40 can be connected to and supported by the ganger bracket 16. The connection therebetween and the support of the interpersonal shield 18 at the lower edge portion 40 can comprise any known connection techniques.

In some embodiments, the ganger bracket 16 can be configured to support the interpersonal shield 18 with the lower end portion 40 disposed at approximately the height of a seating surface 50 of the chair 12. In some embodiments, the lower end portion 40 is disposed lower than the upper seating surface 50 of the chairs 12, 14. This can provide a more complete obstacle directly between the users 20, 22.

In some embodiments, the interpersonal shield 18 is sized and the ganger bracket 16 supports the interpersonal shield 18 in a position such that the upper end portion 42 is disposed at approximately the height of or higher than the respiratory orifices of the user 20 such as the user's mouth 52 and nose 54.

For example, the upper end portion 42 can be disposed at a spacing 60 above the user's mouth 52 and a spacing 62 above the user's nose 54. In some embodiments, the interpersonal shield 18 and the ganger bracket 16 are configured to support the upper edge portion 42 at a height 64 higher than the upper seating surface 50.

An aspect of at least one of the inventions disclosed herein includes the realization that the distance from the respiratory orifices 52, 54 of an average size human adult is approximately two feet or two and a half from an upper surface upon which they may be seated. There are several variables which can affect the ultimate height of such respiratory orifices 52, 54 and thus the distance 64 of approximately two or two and a half feet is a rough approximation of average adults. Thus, providing the upper end portion 42 at a spacing 64 of at least about two and a half feet provides the optional additional advantage of placing at least a portion of the interpersonal shield 18 directly between the respiratory orifices as well as the arms and hands of the two users 20, 22 seated in adjacent chairs 12, 14, as viewed in FIG. 1. However, where chairs are designed for smaller users, including children, other spacings 64 can be used.

Additional optional benefits can be achieved by positioning the upper edge portion 42 substantially higher than the respiratory orifices 52, 54 of a user, such as an average size adult user. For example, in some embodiments, the upper end portion 42 of the interpersonal shield 18 can be provided at a spacing 64 of approximately at least three feet, at least four feet, at least five feet, or more.

With a continued reference to FIG. 2, optionally, the rear edge portion 44 of the interpersonal shield 18 can be disposed rearwardly from the seating surfaces of the chairs 12, 14. For example, the chairs 12, 14 can include an upper seating surface 50 (discussed above) as well as a forward facing backrest surface 70. In some embodiments, the rear edge portion 44 of the interpersonal shield 18 can be positioned at about the same position as or rearwardly from the forward facing backrest surface 70. This can provide additional optional benefits. For example, when a user is seated normally in a chair facing forward, as illustrated in FIGS. 1 and 2, their respiratory orifices 52, 54 typically face in a forward direction, perpendicularly away from the backrest surface 70, and are further additionally spaced forwardly from the backrest surface 70.

Thus, by positioning the rear edge end portion 44 of the interpersonal shield 18 at about the position of or rearwardly from the forward facing backrest surface 70, it can be further assured that the interpersonal shield is positioned directly between the respiratory orifices 52, 54 of users 20, 22 seated in adjacent seats 12, 14.

Additionally, in some embodiments, the front edge portion 46 of the interpersonal shield 18 can be disposed forwardly from the forward facing backrest surface 70. For example, the front edge portion 46 is disposed at a distance 72 from the forward facing backrest surface 70. In some embodiments, the spacing 72 can be at least about six inches. As such, the front edge portion 46 would be disposed at or forwardly from the respiratory orifices 52, 54 of at least some users who when seated in the chair 12 with their back against the forward facing back rest surface 70. Further optional additional advantages can be achieved by providing a spacing 72 of eight or more inches, ten or more inches, 12 or more inches. Further, optionally, the front edge portion 46 can be positioned at approximately a forward edge 74 of the seating surface 50 (illustrated in FIGS. 12 and 25).

FIGS. 3-13 illustrate a modification of the ganged chair assembly 10, identified generally by the reference numeral 110. Parts, components, features, and advantages of the assembly 110 that are the same or similar to parts, components, features, and advantages of the assembly 10 are identified with the same reference numeral, except that "100" has been added thereto.

Figure 3:
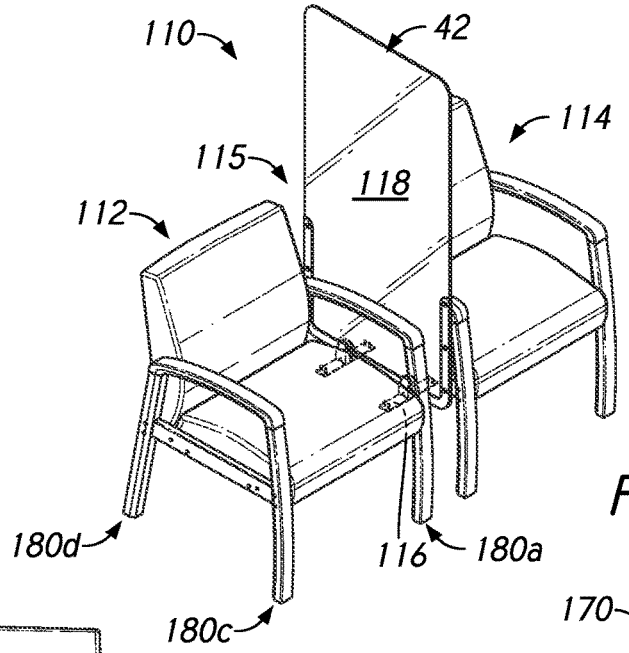
FIG. 3 is a front, right, and top perspective view of another embodiment of a ganged chair assembly with an integrated interpersonal shield.
Figure 4:
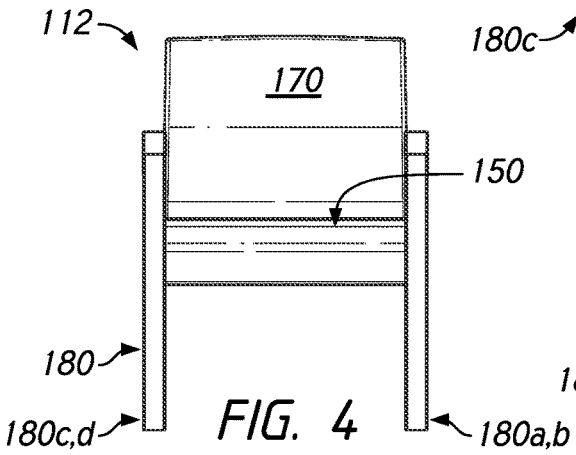
FIG. 4 is a front elevational view of one chair from the embodiment of FIG. 3.
Figure 5:
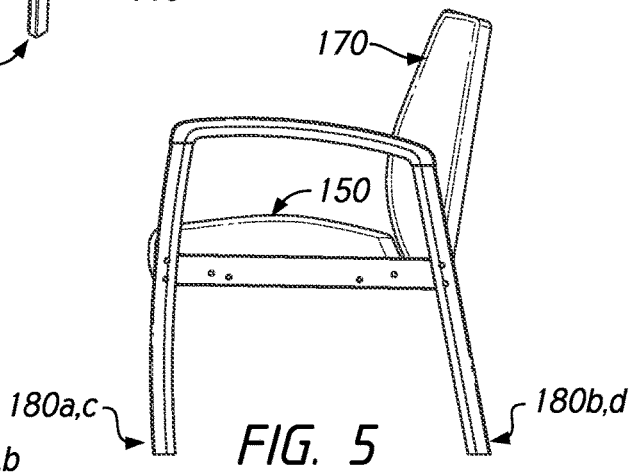
FIG. 5 is a left side elevational view of the chair of FIG. 4.
Figure 6:
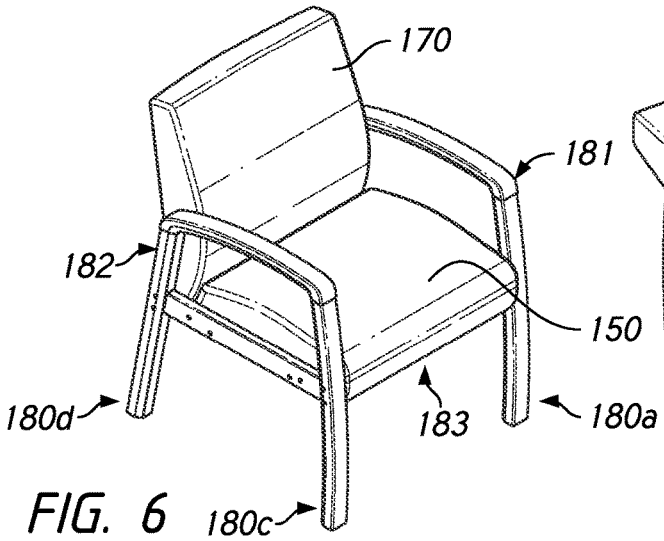
FIG. 6 is a front, top, and right side perspective view of the chair of FIG. 4.
Figure 7:
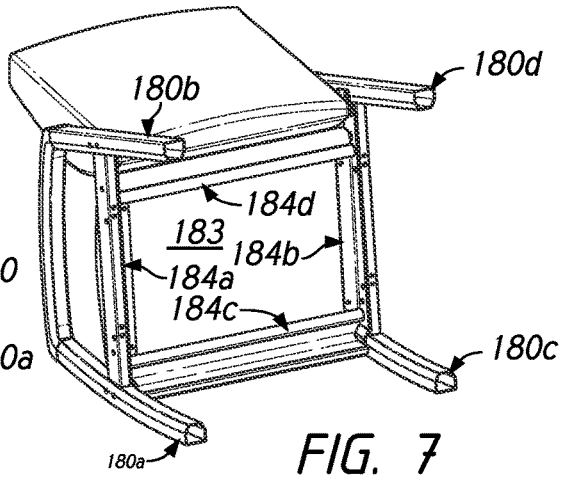
FIG. 7 is a bottom, rear, and left side perspective view of the chair of FIG. 4.

With reference to FIG. 3, like the assembly 10 of FIGS. 1-2, the ganged chair assembly 110 includes a first chair 112, a second chair 114, and a ganger assembly 115 which includes a ganger bracket assembly 116 supporting an interpersonal shield 118. Set forth below, with reference to FIGS. 4-7, is a description of one of the chairs 112, 114 which can be used as the chairs 112, 114 in the assembly 110. Other chairs can also be used.

With references to FIGS. 4-7, the chair 112 includes an upper seating surface 150 and the forward facing backrest surface 170. Various different configurations of the other structural portions of the chair 112 can provide support for the upper seating surface 150 and the forward facing backrest surface 170.

In the illustrated embodiment, the chair 112 includes a plurality of legs 180. The plurality of legs can include a front left leg 180*a*, a rear left leg 180*b*, front right side leg 180*c*, and a rear right side leg 180*d*. In the illustrated embodiment, the front and rear left side legs 180*a*, 180*b* are formed from an inverted U-shape member 181. Similarly, the right side front and rear legs 180*c*, 180*d* are formed from an inverted U-shape member 182. Optionally, the inverted U-shape members 181, 182 can be connected to a sub frame portion 183.

The sub frame portion 183 can include a left side rail member 184*a*, a right side rail member 184*b*, a front cross member 184*c*, and a rear cross member 184*d* generally forming a box frame extending between the inverted U-shape members 181, 182 and configured to support the structure forming the upper seating surface 170 and the backrest surface 170.

In some embodiments, the supporting structure for the upper seating surface 150 can comprise a seating substrate (not shown) formed of a more rigid material, such as wood, plastic, and/or contoured plastic covered by a flexible material such as a foam and which can also be covered by an upholstery forming the upper seating surface 150. As such, the seating substrate can be supported by the sub frame portion 183, structurally, such that the cushion portion can provide a soft, conforming configuration for comfort of the user.

Similarly, the forward facing backrest surface 170 can be supported by a more rigid substrate (not shown) covered with a flexible conforming material, such as a foam, which can be covered by upholstery forming the forwardly facing backrest surface 170. The substrate (not shown) within the backrest portion can be directly connected to the inverted U-shape portions 181, 182 and/or to the sub frame portion 183, for supporting the forward facing backrest surface 170 in the desired orientation.

The ganger bracket 116 can be configured to engage the left side rail 184*a* of the chair 112 and the right side rail 184*b* of the sub frame 183 of the chair 114, as described in greater detail below with reference to FIGS. 10 and 11.

Figure 8:
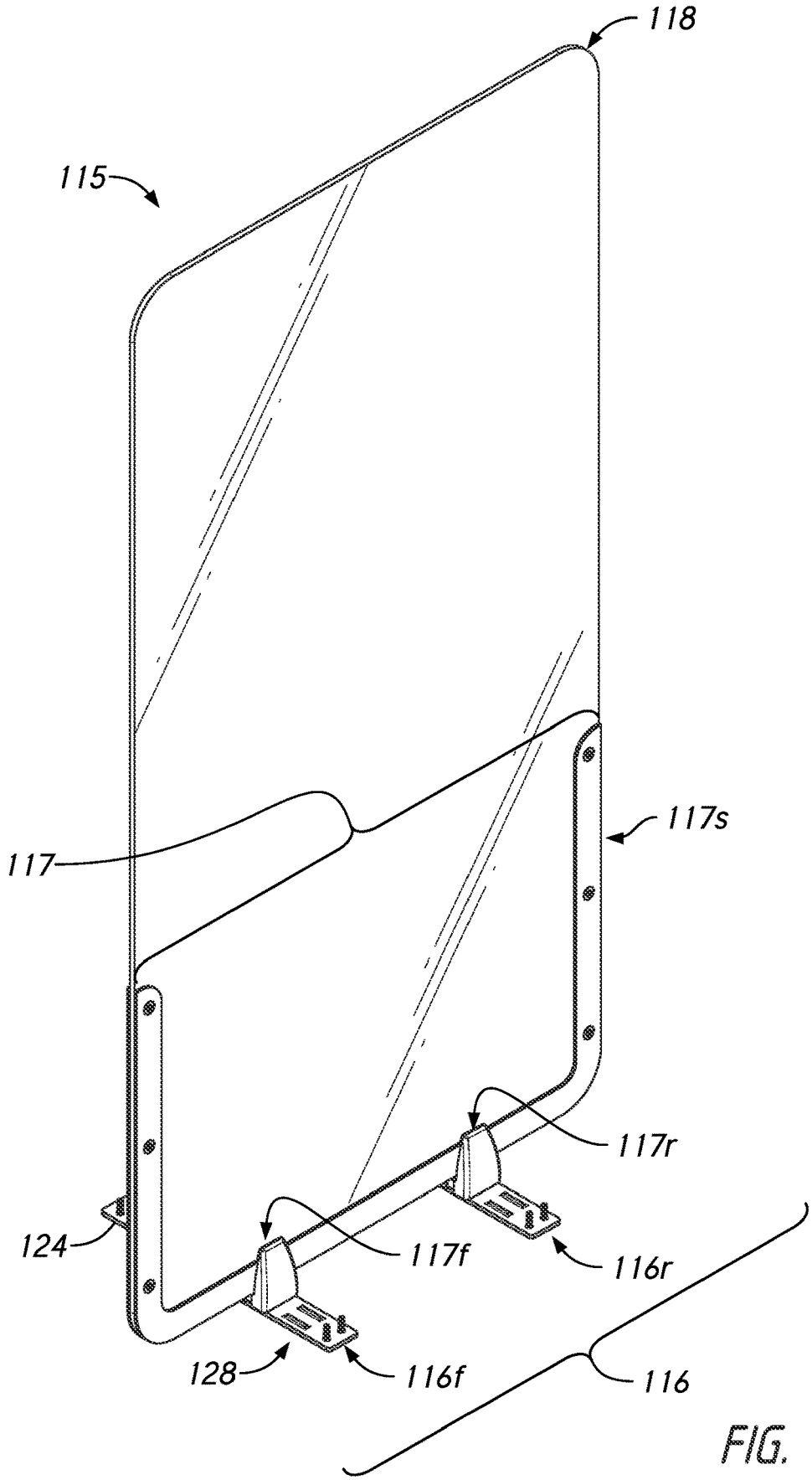
FIG. 8 is a front, top, and left side perspective view of a ganger bracket with integrated personal shield which can be used in the embodiment of FIG. 3.
Figure 9A:
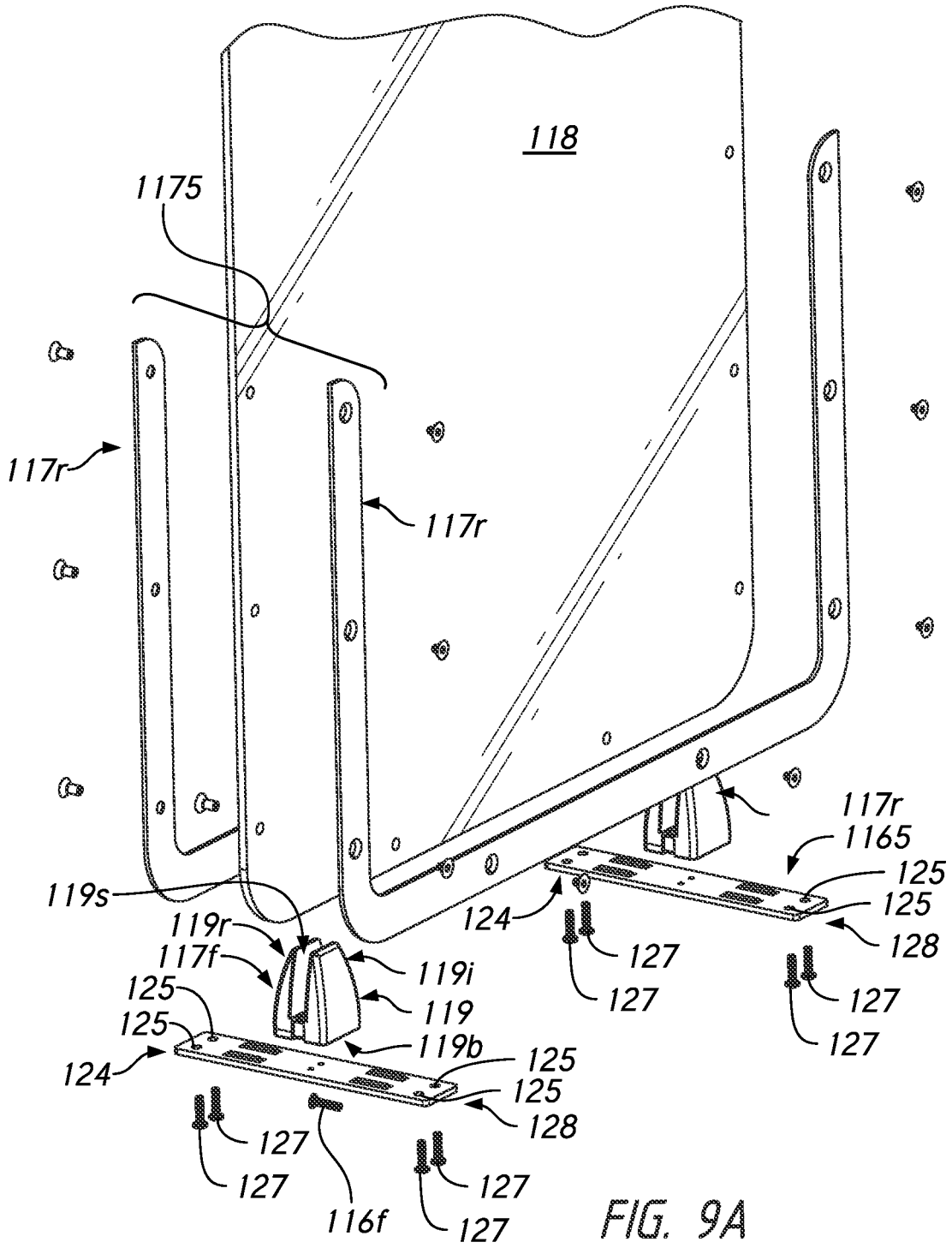
FIG. 9A is an enlarged exploded view of the bracket of FIG. 8.
Figure 9B:
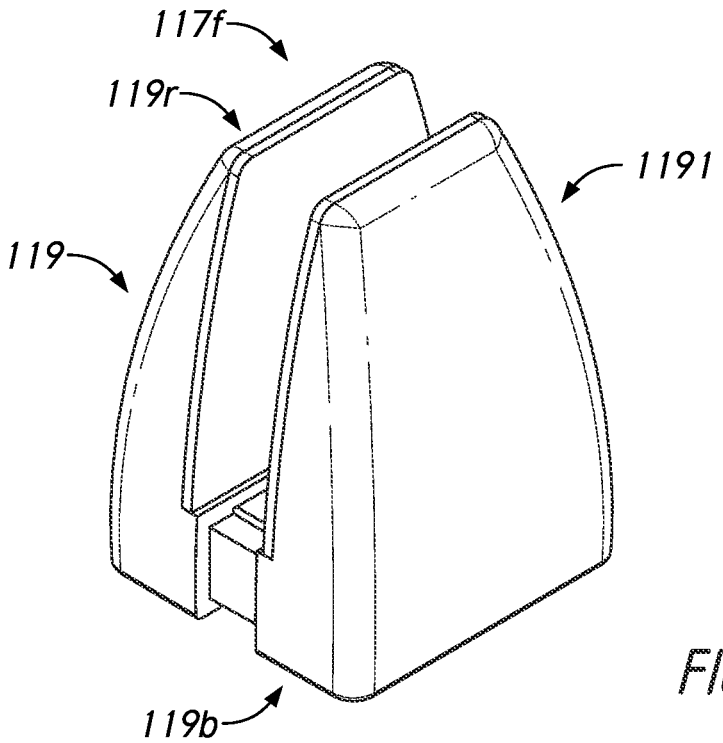
FIG. 9B is an enlarged perspective view of one of the interpersonal shield support blocks included in the bracket of FIG. 8.
Figure 9C:
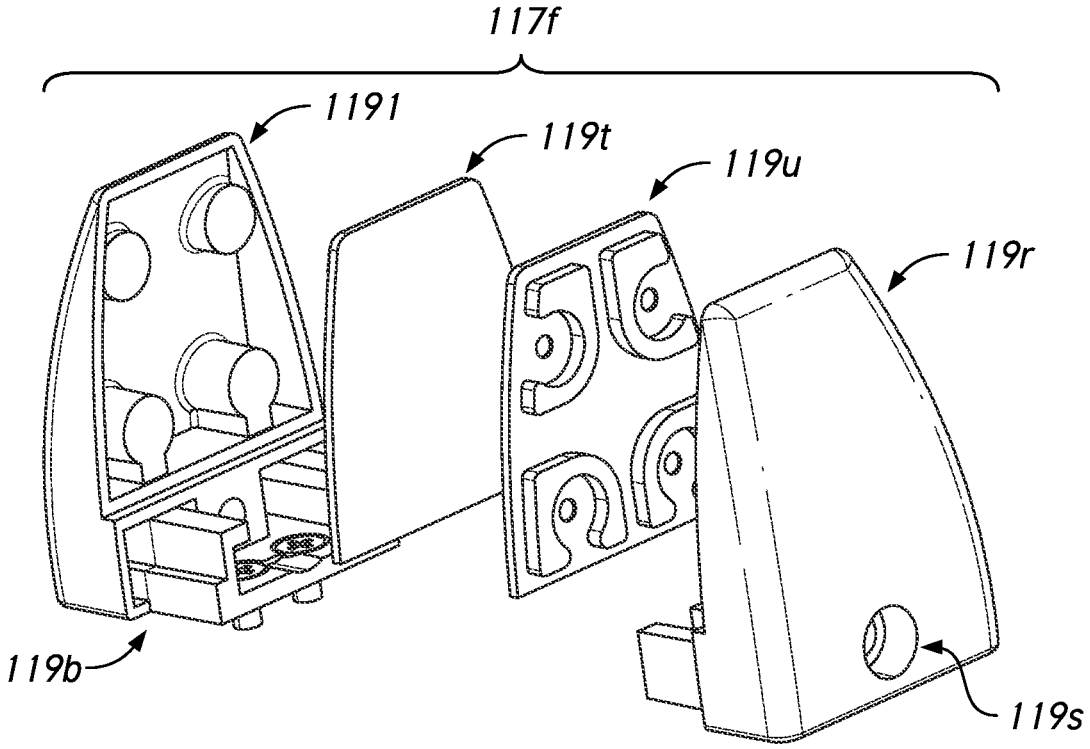
FIG. 9C is an exploded view of the interpersonal shield support block of FIG. 9B.
Figure 9D:
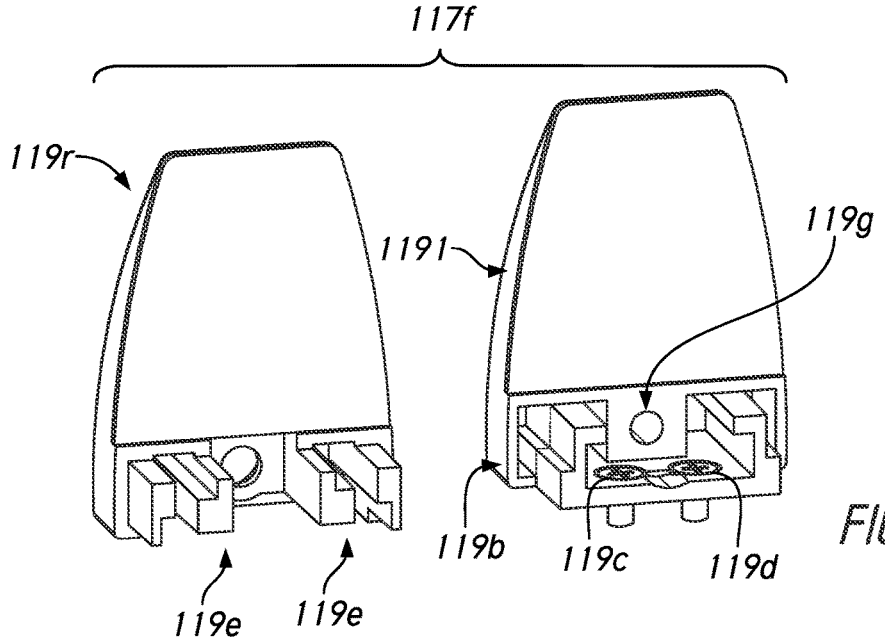
FIG. 9D is a side by side view of two portions forming the interpersonal shield support blocks of FIG. 9B.
Figure 9E:
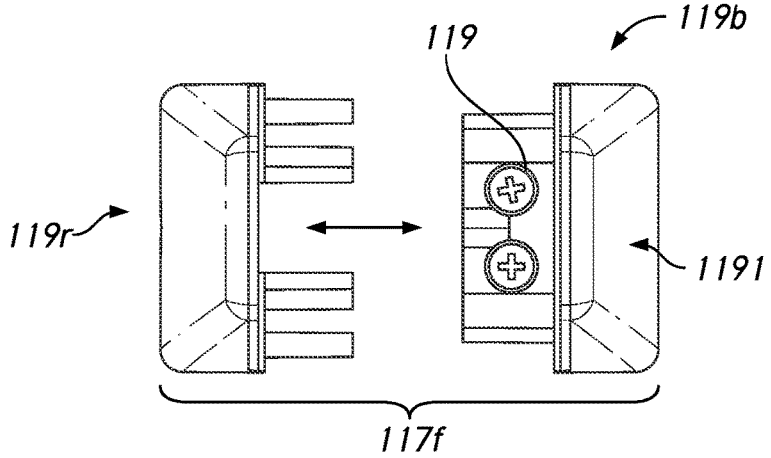
FIG. 9E is a top plan, exploded view of the interpersonal shield support block of FIG. 9B.
Figure 9F:
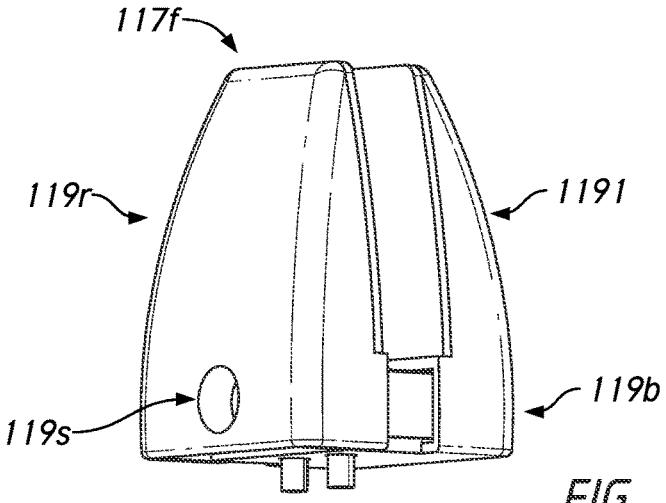
FIG. 9F is another a perspective view of the interpersonal shield support block of FIG. 9B.

FIGS. 8 and 9 illustrate the ganger bracket with integrated interpersonal shield 115, removed from the chairs 112, 114. The ganger bracket assembly 116 can include a front ganger bracket 116*f* and a rear ganger bracket 116*r*. Other configurations can also be used. The front ganger bracket 116*f* is described below in detail. The rear ganger bracket 116*r* can have the same or similar configuration.

As shown in FIG. 9, the front ganger bracket 116*f* can include a first end portion 124 and a second end portion 128. The first and second end portions 124, 128 are configured to attach to portions of the chairs 112, 114 (FIG. 3). For example, the first and second end portions 124, 128 can include through-holes 125 alignable with similar through-holes (not shown) provided on left and right side rails 184*a*, 184*b* (FIG. 7) for attaching the chairs 112, 114 together.

More specifically, the first end portion 124 can include an arrangement of through-holes 125 configured to be alignable with through-holes on the left side rail 184*a* of the chair 112 and the second end portion 128 can include an arrangement of through-holes 125 alignable with through-holes (not shown) on the right side rail 184*b* of the chair 114. Threaded fasteners 127 can be used for attaching the first and second ends 124, 128 to the left and right side rails 184*a*, 184*b* of the chairs 112, 114, via the through-holes 125. Additional, optional, further benefits can be achieved by providing multiple mounting locations, such as the through-holes 125, and each of the first and second ends 124, 128 of the ganger bracket member 116*f*. Multiple mounting locations can provide additional resistance against a racking moving of connected chairs 112, 114.

The ganger bracket assembly 116 can also include an interpersonal shield mounting assembly 117 configured to support the interpersonal shield 118. For example, the interpersonal shield mounting assembly 117 can include a front support 117*f*, a rear support 117*r* and an optional reinforcing assembly 117*s*.

For example, in some embodiments, the front ganging bracket 116*f* can include an interpersonal shield mount 117*f* and the rear ganging bracket 116*r* can include an interpersonal shield mount 117*r*. The front and rear interpersonal shield mounts 117*f*, 117*r* can comprise support blocks 119.

For example, with reference to FIG. 9, the front interpersonal shield mount 117*f* can include a support block member 119 with a base portion 119*b* configured for mounting to a central portion of the front ganging bracket 116*f* and a slot portion 119*s* configured to support the shield 118. The slot portion 119*s* can be defined by left and right side wall portions 119*l*, 119*r* extending upwardly from the base 119*b*. The slot portion 119*s* can be configured to provide a clearance or interference fit with the interpersonal shield 118. In other embodiments, the left and right side wall portions 119*l*, 119*r* can be configured to clamp the shield 118 or the reinforcement assembly 117*s*.

In some embodiments, the reinforcement assembly 117*s* can comprise a left reinforcing member 117*l* and a right side reinforcing member 117*r*. Each of the reinforcing members 117*l*, 117*r* can be in the form of a peripheral member made from a structural material such as aluminum, steel, plastic, or other materials capable of providing additional structural support to the interpersonal shield 118. In the illustrated embodiment, the reinforcing members 117*l*, 117*r* are generally U-shaped and extend along a periphery of a bottom portion of the interpersonal shield 118. Further, the reinforcing members 117*l*, 117*r* can be attached to one another through the interpersonal shield 118 with appropriate fasteners, such as rivets, bolts, screws, adhesives, or other types of fasteners.

In such an embodiment, the slot portion 119*s* of the interpersonal shield support block 119 is sized to form a clearance and/or interference fit with the outer surface as defined by the reinforcement assembly 117*s* secured to outer surfaces of the interpersonal shield 118. In some embodiments, additional fasteners can be inserted through these interpersonal shield support blocks 119 and the interpersonal shield assembly 118 including the reinforcement assembly 117. In some embodiments, the interpersonal shield assembly 118 is held in place with a friction and/or interference fit between the slot 119*s* and the reinforcement assembly 117.

With reference to FIGS. 9B-9F, the support blocks 119 can be configured to clamp onto the shield 118. For example, the base 119*b* and one of the side walls 119*l* can be formed as a single member. The base 119*b* can include through holes in a lower portion for securement to the bracket 116*f* with threaded fasteners 119*c*. The base can also include a passage or keyway 119*d* configured to support a sliding engagement with side wall 119*r*.

For example, the side wall 119*r* can include a key portion 119*e* configured for sliding engagement and positive registration with the keyway 119*d*. As such, the side walls 119*l, r* can slide in manner to adjust the size of the slot 119*s*. Optionally, the side wall 119*r* can include a through hole in alignment with a threaded boss 119*g* arranged such that a threaded fastener (not shown) can be inserted through the through hole, into engagement with the boss 119*g*, and thereby used to move the side wall 119*r* toward the sidewall 119*l* and thereby clamp the shield 118 and/or the reinforcement assembly 117*s*. Optionally, the support block 119 can include pads 119*t*, 119*u* made from a conforming material so as to improve contact with the shield 118 and/or the reinforcement assembly 117*s*.

Figure 10:
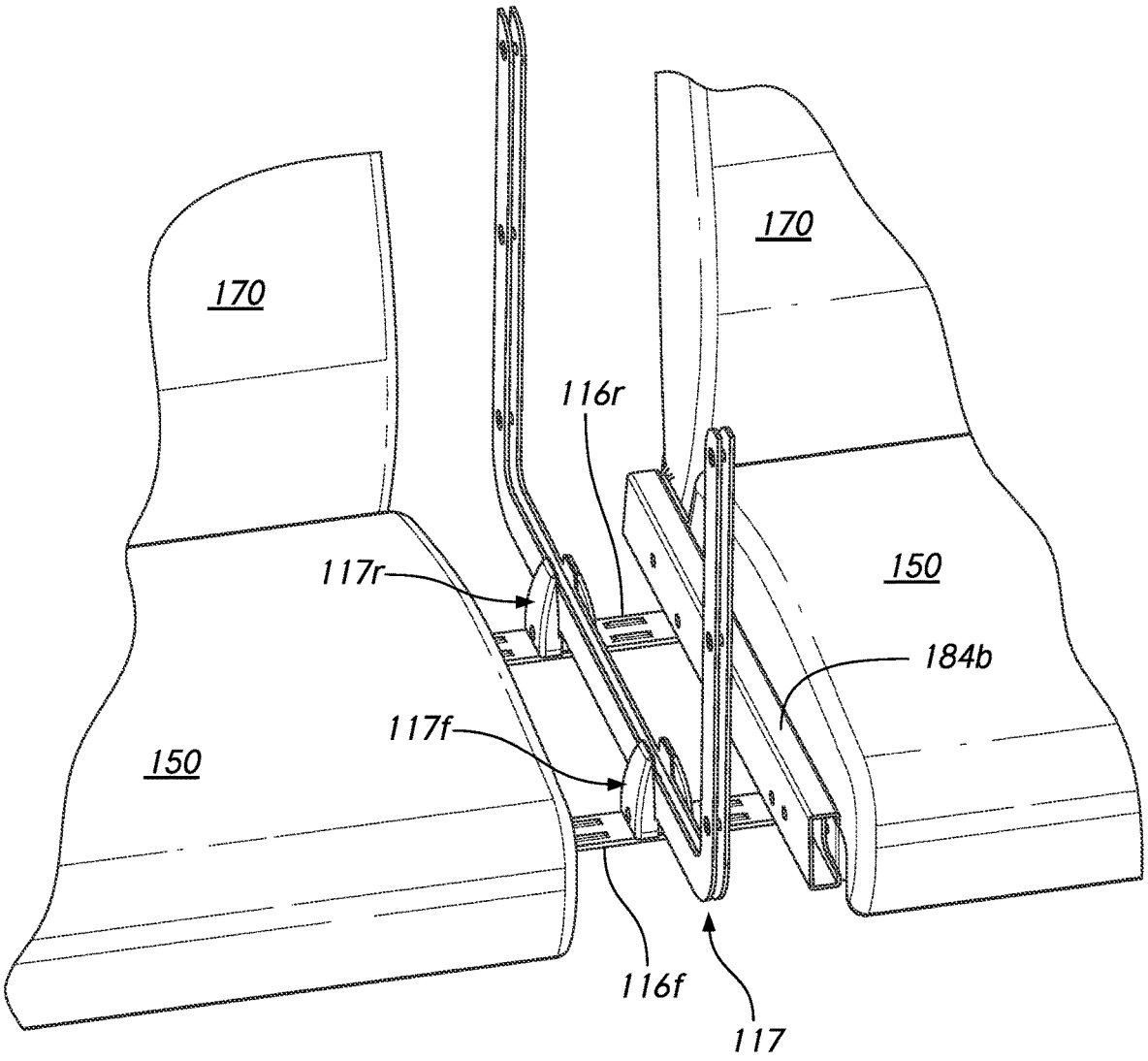
FIG. 10 is an enlarged front, top, and right side perspective view of the embodiment of FIG. 3 with two arm rests and the front and rear legs of the two chairs, and the interpersonal shield member removed.
Figure 11:
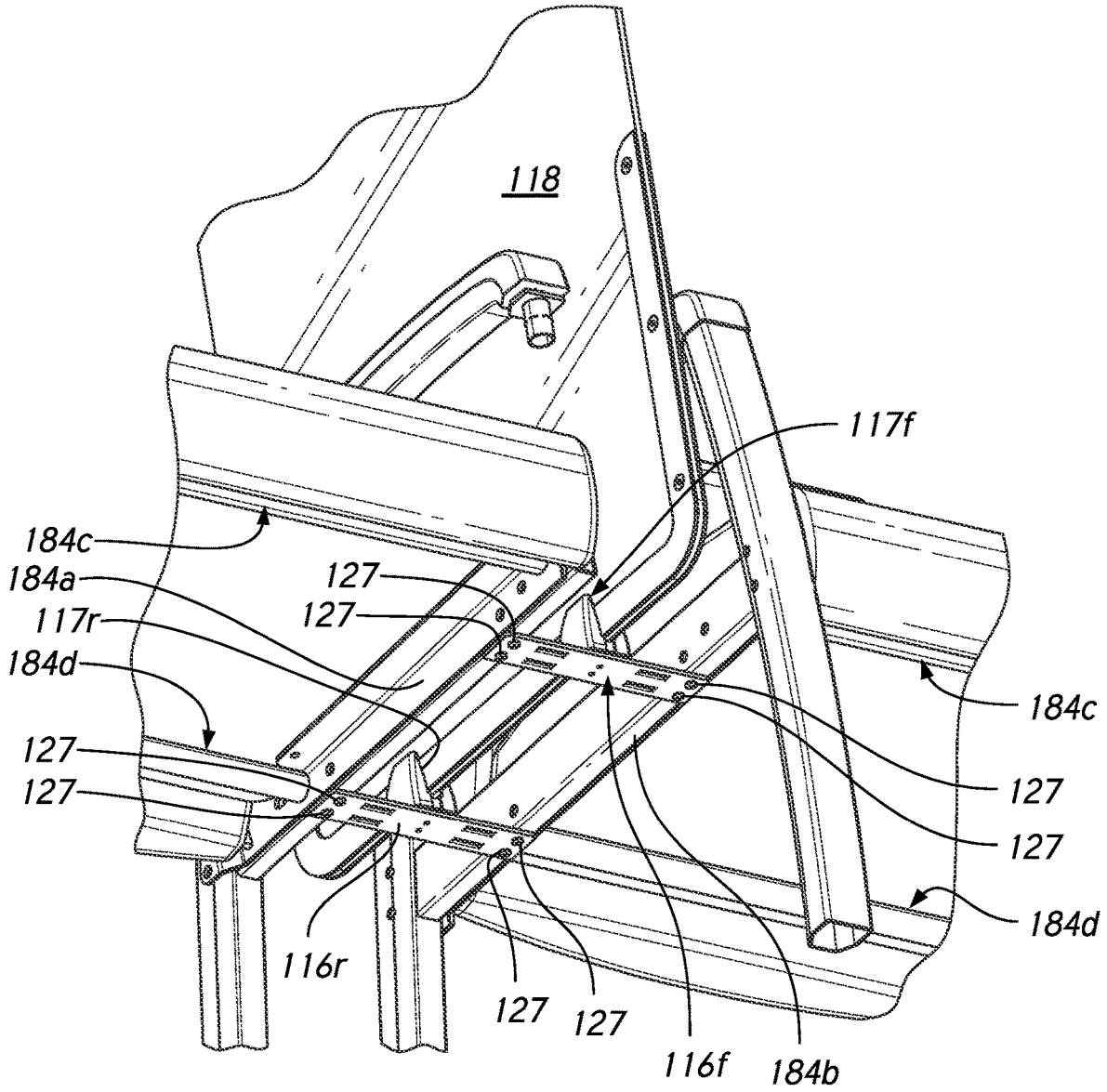
FIG. 11 is a bottom, front, left side perspective view of the embodiment of FIG. 10, with a front leg of one of the chairs removed.
Figure 12:
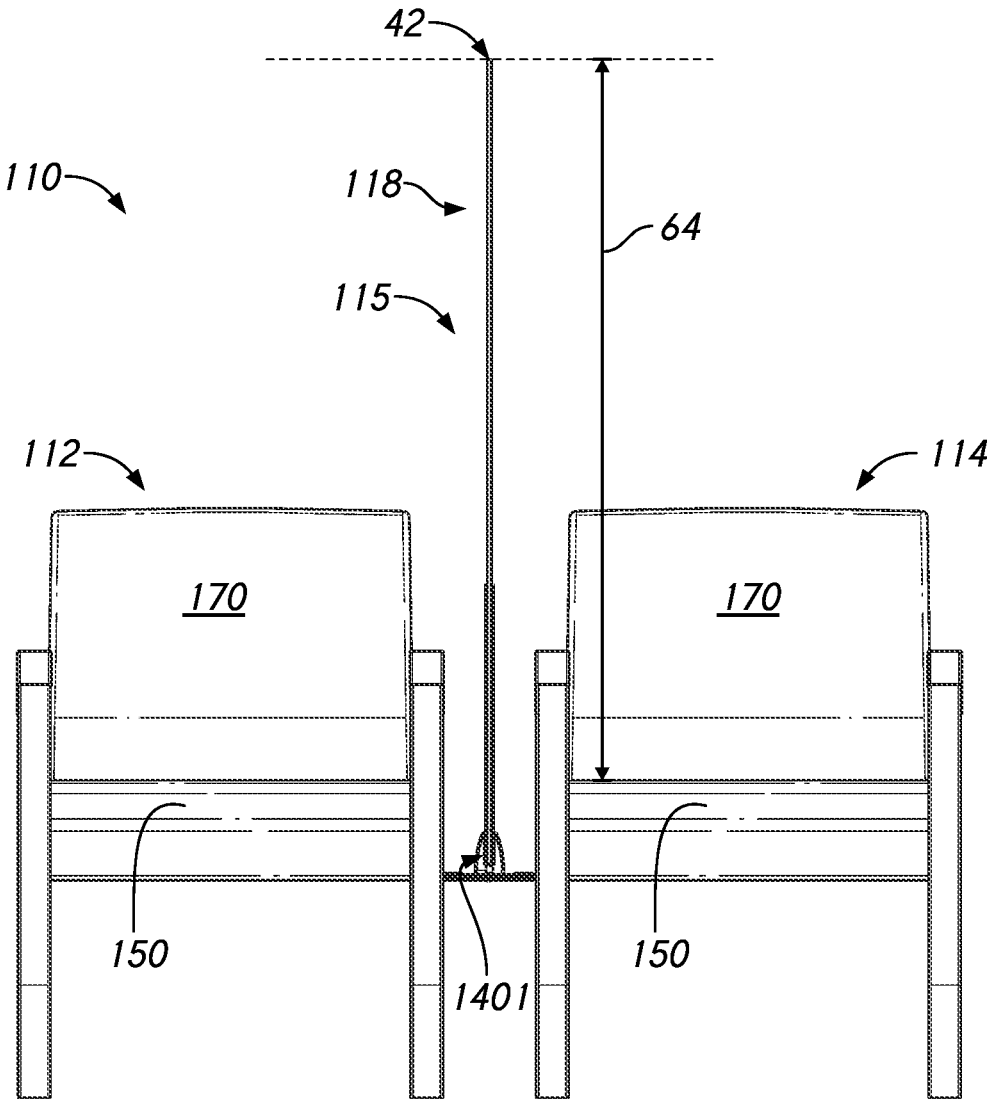
FIG. 12 is a front elevational view of the embodiment of FIG. 3.
Figure 13:
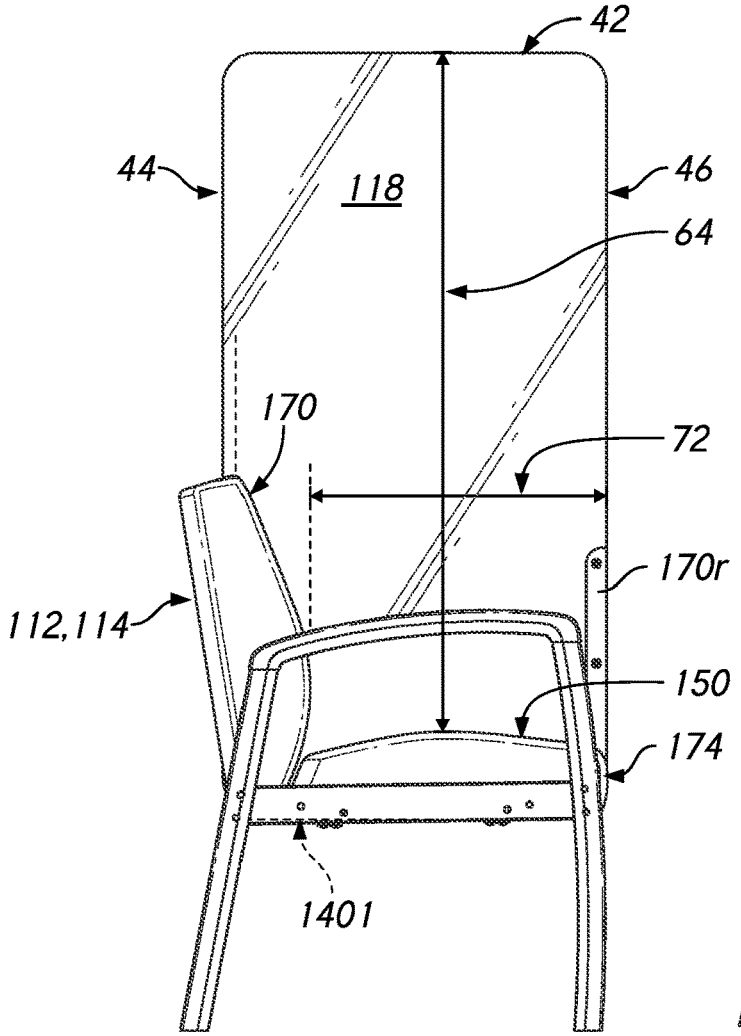
FIG. 13 is a right side elevational view of the embodiment of FIG. 3.
Figure 14:
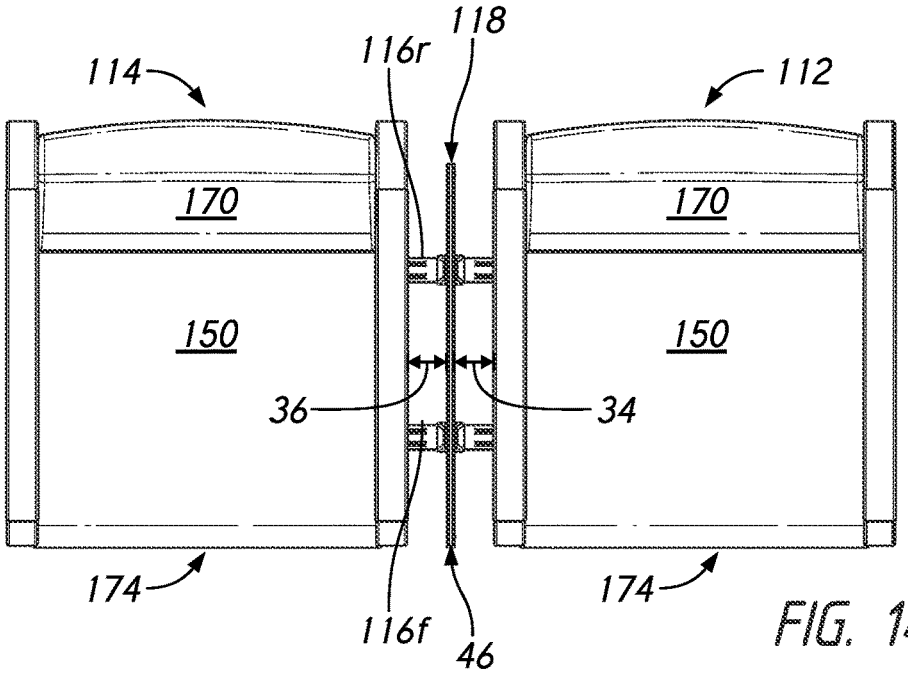
FIG. 14 is a top plan view of the embodiment of FIG. 3.
Figure 15:
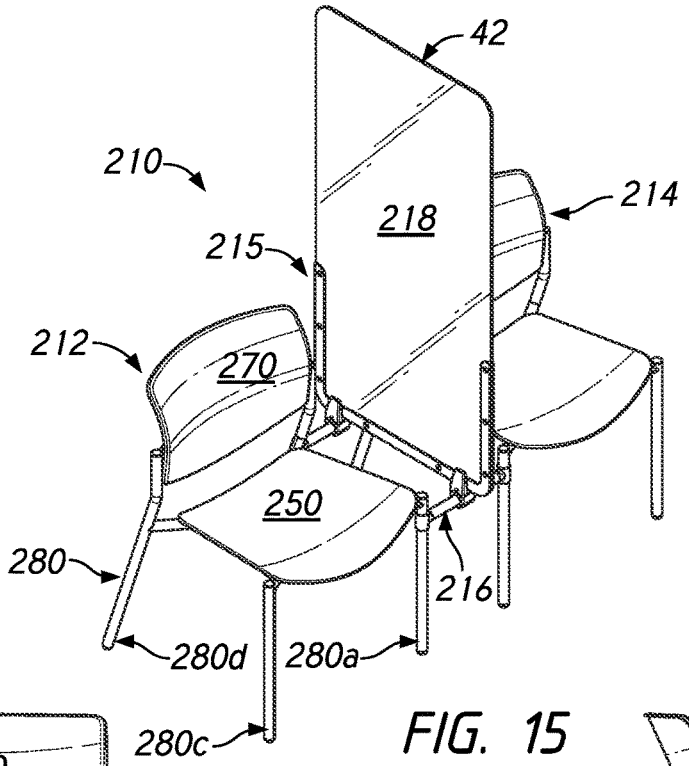
FIG. 15 is a front, top, and right side perspective view of another embodiment of a ganged chair assembly with an integrated interpersonal shield.
Figure 16:
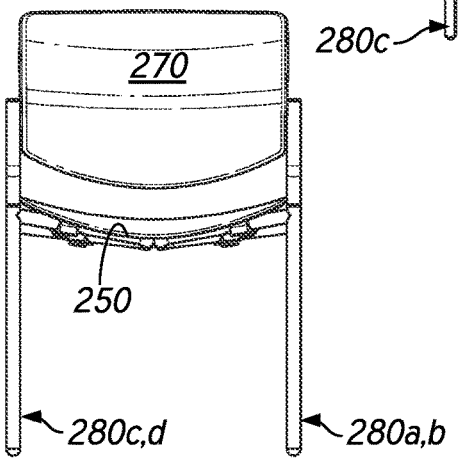
FIG. 16 is a front elevational view of one of the chairs of the embodiment of FIG. 15.

With reference to FIGS. 10 and 11, the front and rear ganging brackets 116*f*, 116*r* can be attached to the left and right side rails 184*a*, 184*b* with fasteners 127, as described above. FIGS. 12-14 illustrate the ganging bracket assembly 115 connecting the chairs 112, 114 illustrated in FIG. 3.

FIGS. 15-26 illustrate yet another embodiment of the ganged chair assembly with integrated interpersonal shield 10, identified generally by the reference numeral 210. Parts, components, features, and advantages of the embodiment 210 are identified with the same reference numerals as the corresponding parts, components, features, and advantages of the embodiment identified as 110, except that "100" has been added to the reference numerals thereof.

With continued reference to FIGS. 15-18, like the embodiments of FIG. 3-14, the ganger assembly 215 connects to chairs 212, 214, however, the configuration of the chairs 212, 214 are different than the chairs 112, 114, and thus the ganger assembly 215 has other optional features.

With regard to the configuration of the chairs 212, 214, the chair 212 is described below, however, the same description also applies to the chair 214.

The chair 212 includes an upper seating surface 250 and a forward facing backrest surface 270. The chair 212 also includes a plurality of legs 280. The plurality of legs 280 includes a front left leg 280*a*, a rear left leg 280*b*, a front right side leg 280*c*, and a right rear leg 280*d*.

The chair 212 also includes a subframe portion 283. In the illustrated embodiment, the subframe portion includes a left side member 283*a* and a right side member 283*b*. Left and right side subframe members 283*a*, 283*b* are generally v-shaped and attached to one another at their center. Each of the ends of the left and right members 283*a*, 283*b* are attached to a front and rear leg, respectively. More specifically, in the illustrated embodiment, the left and right subframe members 283*a*, 283*b* are connected to the legs, 280*a*, 280*b*, 280*c*, 280*d* at T-joints. As such, the subframe 283 supports a substrate which forms the upper seating surface 250. In some embodiments, the substrate can be made of a molded plastic and may or may not include a cushion or upholstery. As such, the upper surface of the substrate serves as the upper seating surface 250.

In the illustrated configuration, the rear legs 280*b*, 280*d* extend upwardly beyond the connections to the subframe portions 283*a*, 283*b*, to a backrest member forming the forwardly facing backrest surface 270.

Figure 17:
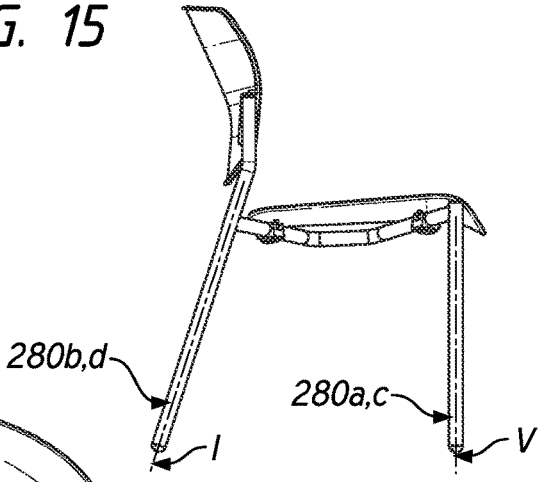
FIG. 17 is a right side elevational view of one of the chairs of FIG. 15.
Figure 18:
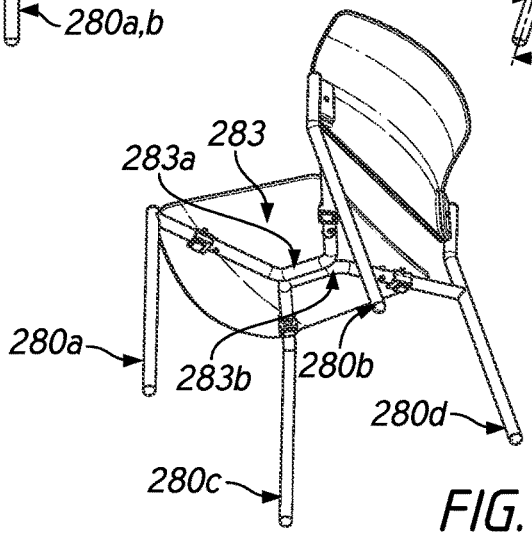
FIG. 18 is a bottom, rear, and left side perspective view of the chair of FIG. 16.

Additionally, the legs 280*a*, 280*b*, 280*c*, 280*d* and subframe 283 can be made from a round structural material such as rod or pipe. Other materials can also be used. Additional, as shown in FIG. 17, the rear legs 280*b*, 280*d* are not parallel to the front legs, 280*a*, 280*c*. For example, the front legs 280*a*, 280*c* extend along a generally vertical axis V and the rear legs 280*b*, 280*d* extend along an inclined axis I. This type of configuration is well known.

Figure 19:
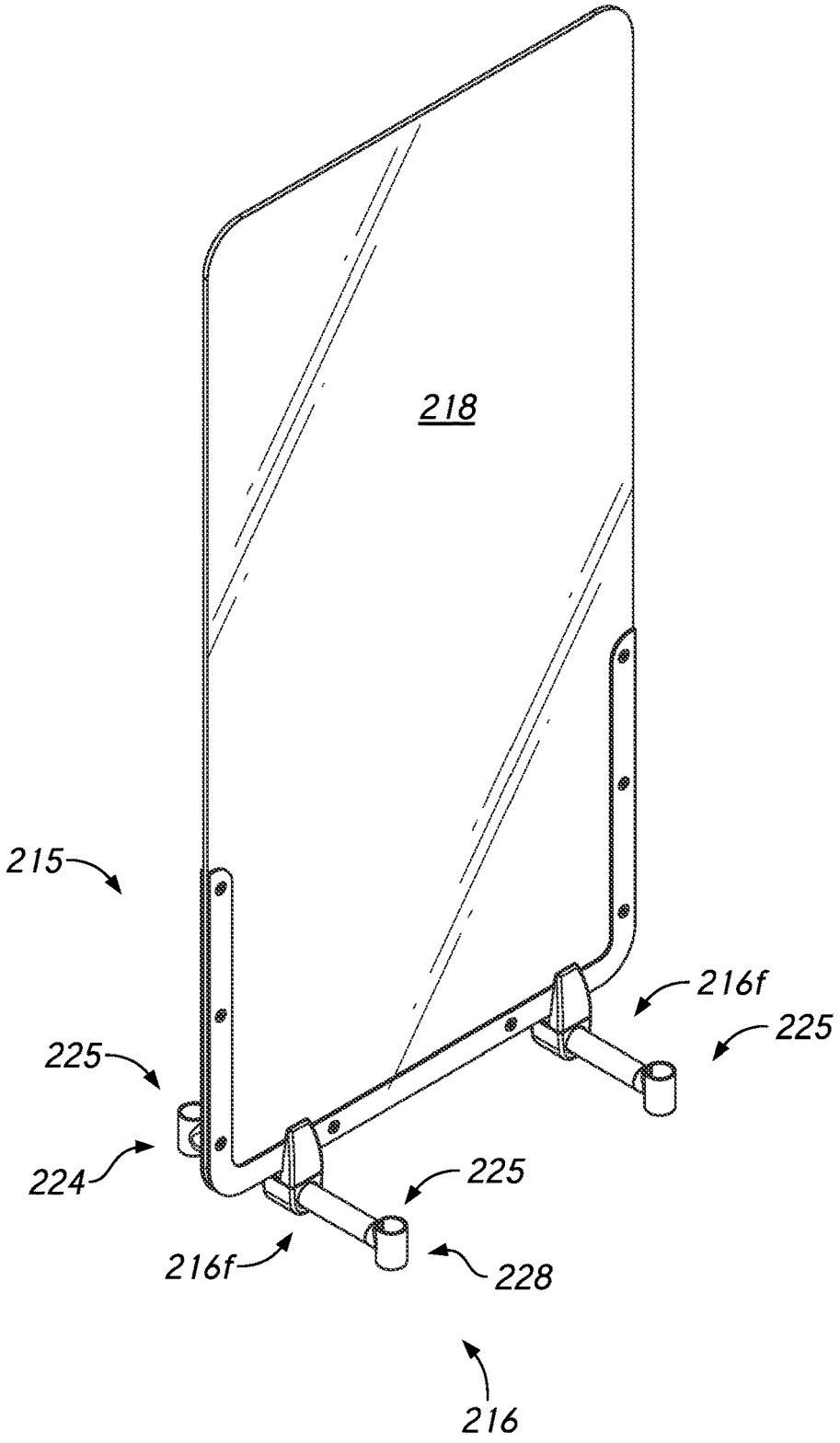
FIG. 19 is a front, top, and left side perspective view of the ganger bracket integrated with a personal shield of the embodiment of FIG. 15.
Figure 20:
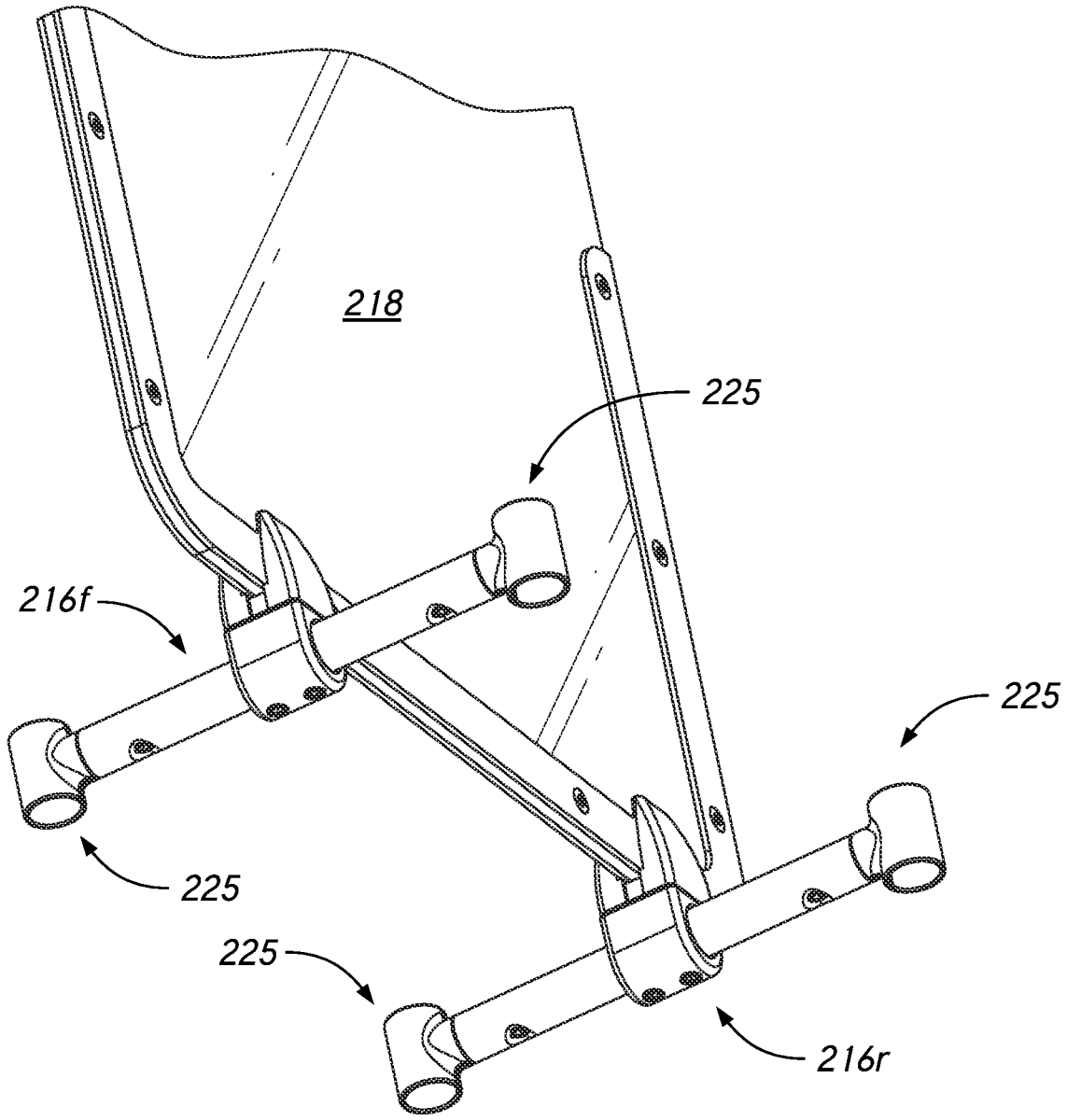
FIG. 20 is an enlarged bottom, front, and left side perspective view of the bracket of FIG. 19.

With continued reference to FIGS. 19-21, the ganger bracket assembly 216 can include a front bracket 216*f* and a rear ganger bracket 216*r*. Other configurations can also be used. The front ganger bracket 216*f* is described below, however, the rear ganger bracket 216*r* can have the same or similar configuration.

With continued reference to FIG. 19, the front ganger bracket 216*f* can include a first end portion 224 and a second end portion 228. The first and second end portions 224, 228 are configured to attach to portions of the chairs 212, 214. For example, the first and second end portions 224, 228 can include collar assemblies 225, configured to engage front legs 280*a*, 280*c* of the chairs 212, 214. Similarly, the collar assemblies 225 of the rear ganger bracket 216*r* can be configured to connect to the rear legs 212, 214.

Optionally, the collar assemblies 225 can be configured to extend around and clamp onto the plurality of legs 280. For example, with reference to FIGS. 21, 12B, and 21C, the collar assemblies 225 can include an aperture portion 252*a* and leg members 225*b*, 225*c*. The collar assembly 225 can be split between the leg portions 225*b*, 225*c* such that the passage 225*a* can be opened to provide for easier installation, for example, by sliding the collar portion 225 up over the bottom ends of the legs 280, to the desired position. With this configuration, a threaded fastener 225*d* (FIG. 21B) can be inserted through an aperture in the legs 225*b*, 225*c* and tightened so as to tighten or constrict the passage 225*a* around the corresponding leg 280. As such, the passage 225*a* can be considered as serving as a constrictable collar portion.

The front ganging bracket 216*f* can also include a central member 229 configured to connect to collar assemblies 225 to one another and to support the interpersonal shield mount 219. For example, the central member 229 can have any cross section. In the illustrated embodiment, the central member 229 in the configuration of a pipe with an inner diameter large enough to receive the legs 225*b*, 225*c* of the collar assemblies 225.

Assembled, the legs 225*b*, 225*c* can be inserted into the central member 229 and set screws 225*e* can be inserted through the central member 229 and into contact with the legs 225*b*, 225*c* to secure the collar assembly 225 in place. Optionally, the legs 225*c*, 225*b* can include apertures 225*i* and aligned recesses for receiving enlarged portions of threaded fastener hardware. For example, the leg 225*c* can include a recess 225*e* around the aperture 225*i* configured to receive an enlarged head of the fastener 225*d*. The recess 225*e* can be shaped so as to allow the enlarged head to be seated sufficiently deeply in the leg 225*c* such that the head of the fastener 225*d* does not interfere with the insertion of the legs 225*c*, 225*b*, into the central member 229. Similarly, the leg 22*b* can include a recess 225*f* around the aperture 225*i* configured to receive a nut 225*g* configured for threaded engagement with the fastener 225*d*. The recess 225*f* preferably includes facets (not shown) for positive registration with the nut 225*g*. The recess 225*g* can be shaped so as to allow the nut 225*g* to be seated sufficiently deeply in the leg 225*b* such that the head of the nut 225*g* does not interfere with the insertion of the legs 225*c*, 225*b*, into the central member 229. Thus, with the fastener 225*d*, inserted through the aperture 225*i* and tightened to the nut 225*g*, for example, with the passage 225*a* tightened around a chair leg, the legs 225*b, c*, can be inserted into the central member 229, with the fastener 225*d* and nut 225*g* hidden from view and protected from tampering.

The collar assembly 225 can also include an aperture 225*h* for anchoring the collar assembly 225 to the central member 229. For example, the aperture 225*h* can be formed with portions of one or both of the legs 225*b*, 225*c* and configured to receive a portion of a set screw, such as a set screw 225*p*. In some embodiments, the aperture 225*h* extends along a direction that is transverse to the aperture 225*i*, and thus can be nested more closely with the aperture 225*i*.

Figure 21A:
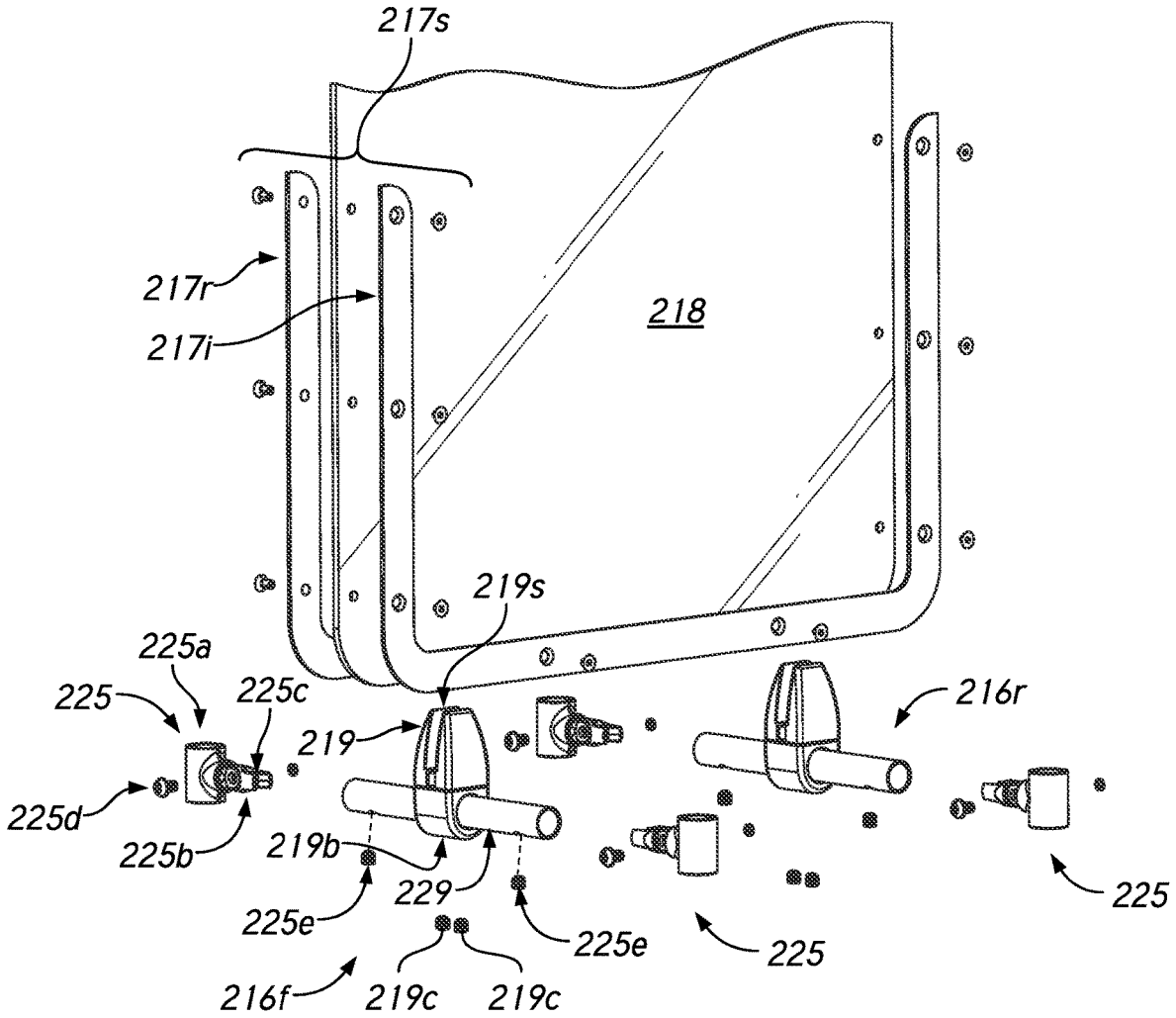
FIG. 21A is an exploded view of the bracket of FIG. 19.
Figure 21B:
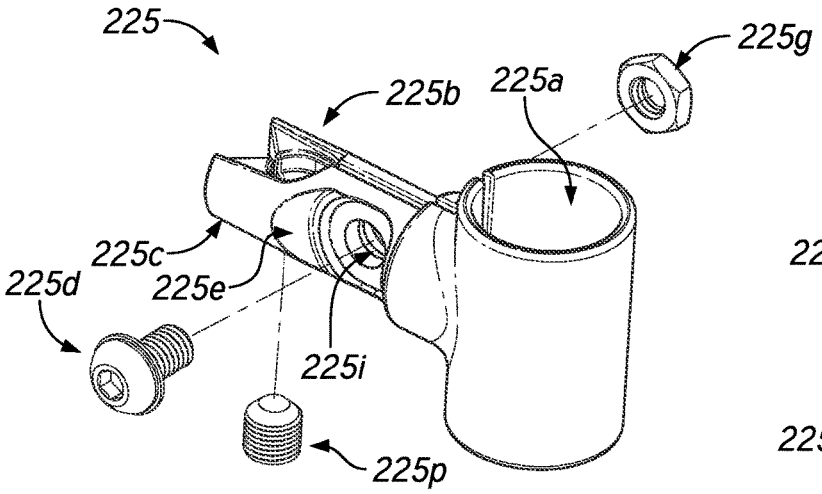
FIG. 21B is an enlarged perspective and exploded view of a collar included in the bracket of FIG. 21A.
Figure 21C:
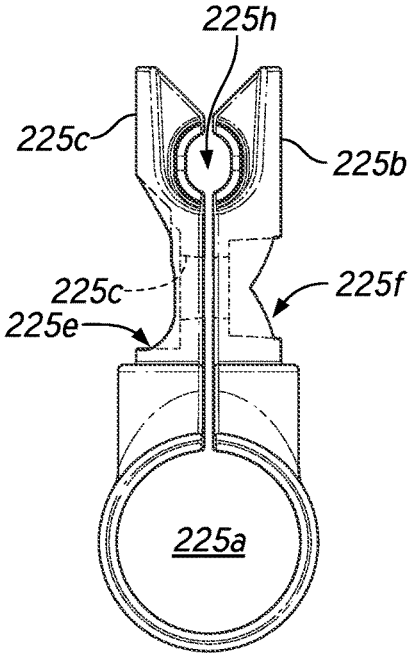
FIG. 21C is a top plan view of the collar of FIG. 21B.
Figure 21D:
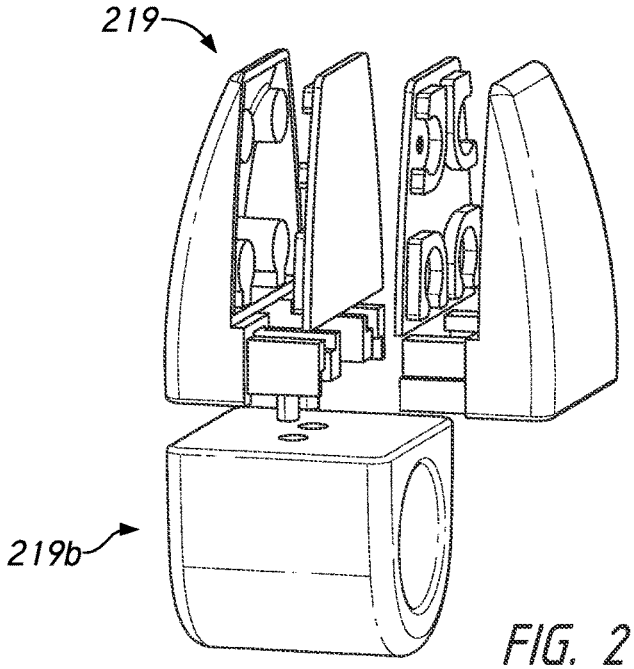
FIG. 21D is a perspective, exploded view of the interpersonal support block included with the bracket of FIG. 21A.

With reference to FIGS. 21A and 21D, in the illustrated embodiment, the interpersonal shield mounts 219 include a base portion 219*b* configured to extend over an outer surface of the central member 229. The base portion 219*b* can include through holes configured to receive set screws 219*c* for securing the mount 219 in the desired location along the central member 229.

Like the ganger assembly 115, the ganger assembly 215 can include an optional reinforcement assembly 217*s* including right and left reinforcing member 217*r* and 217*l* which, when assembled, fit into slot portions 219*s* of the supports 219.

Figure 22:
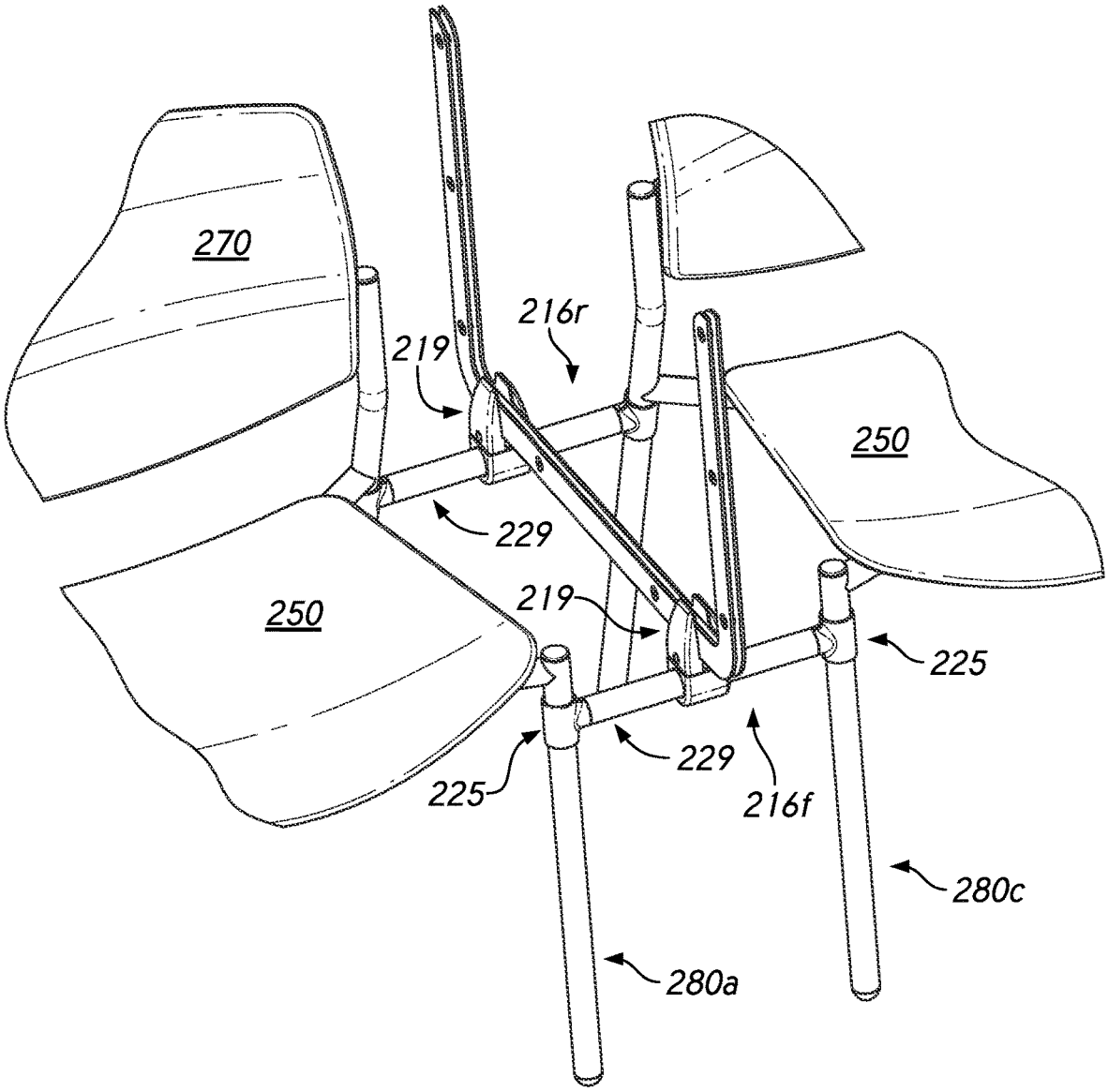
FIG. 22 is a front, top, and right side perspective view (enlarged) with the interpersonal shield member removed.
Figure 23:
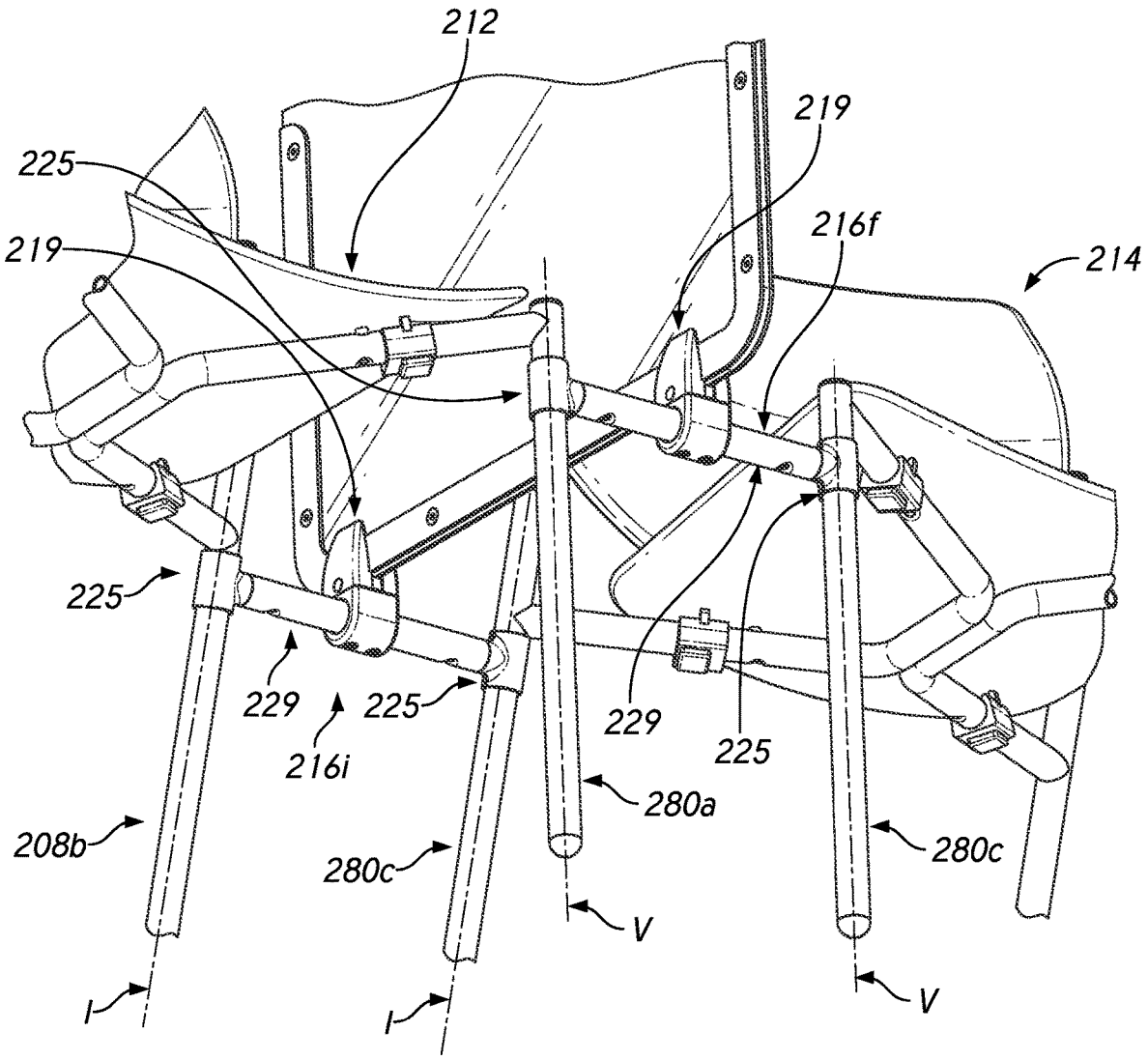
FIG. 23 is an enlarged, front, bottom, and right side perspective view of the bracket which can be used in the embodiment of FIG. 15.

With reference to FIGS. 22 and 23, the collar portions 225 of the front ganger bracket 216*f* extend around and are clamped to the left front leg 280*a* of the chair 212 and the right front leg 280*c* of the second chair 214. As such, the collar portions 225 of the front ganger bracket 216*f* are aligned along the generally vertical axis V extending through the front legs 280*a*, 280*c*.

With regard to the installation of the rear ganger bracket 216*r*, the collar assemblies 225 would be rotated relative to the collar assembly 225 on the front ganger bracket 216*f* due to the difference in alignment of the front legs with the rear legs, as explained above with reference to FIG. 17. More specifically the collar assemblies 225 of the front ganger bracket 216*f* would be aligned along the axis V for connecting two front legs 280, 280*c* and collar assemblies 225 of the rear ganger bracket 216 *r* would be rotated to be aligned with axis I extending along the legs 280*b*, 280*d*.

Figure 24:
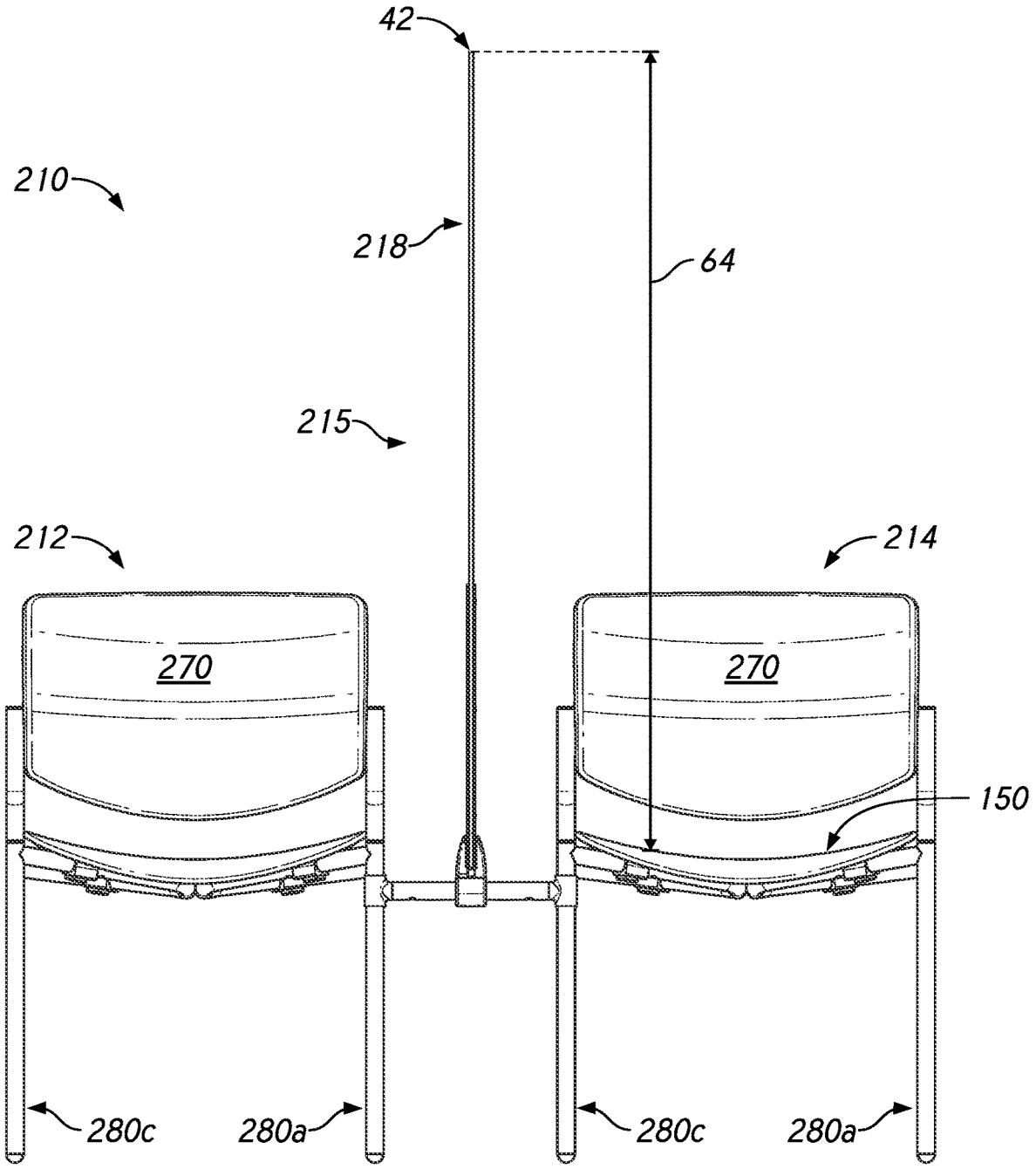
FIG. 24 is a front elevational view of the embodiment of FIG. 15.
Figure 25:
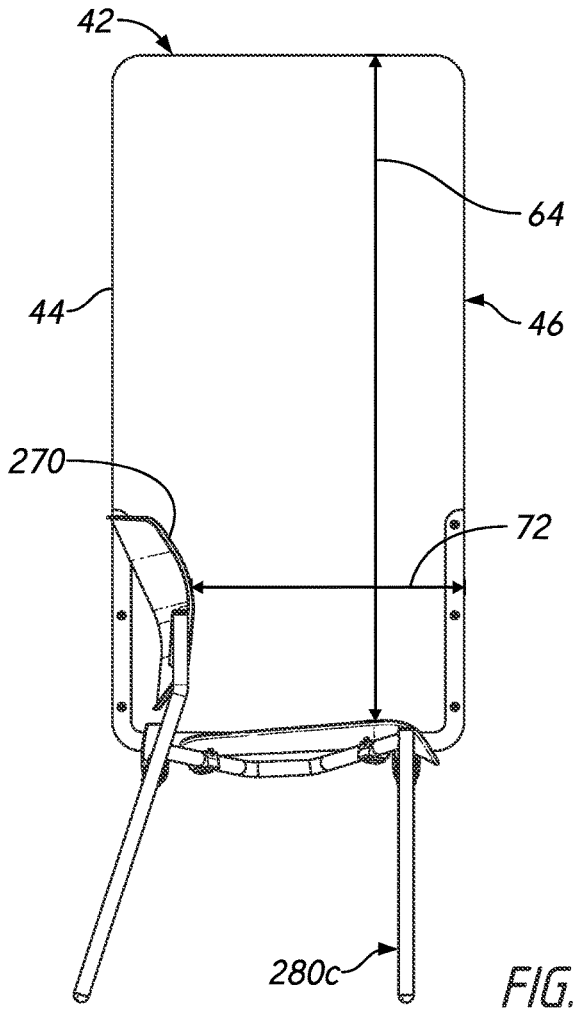
FIG. 25 is a right side elevational view of the embodiment of FIG. 15.
Figure 26:
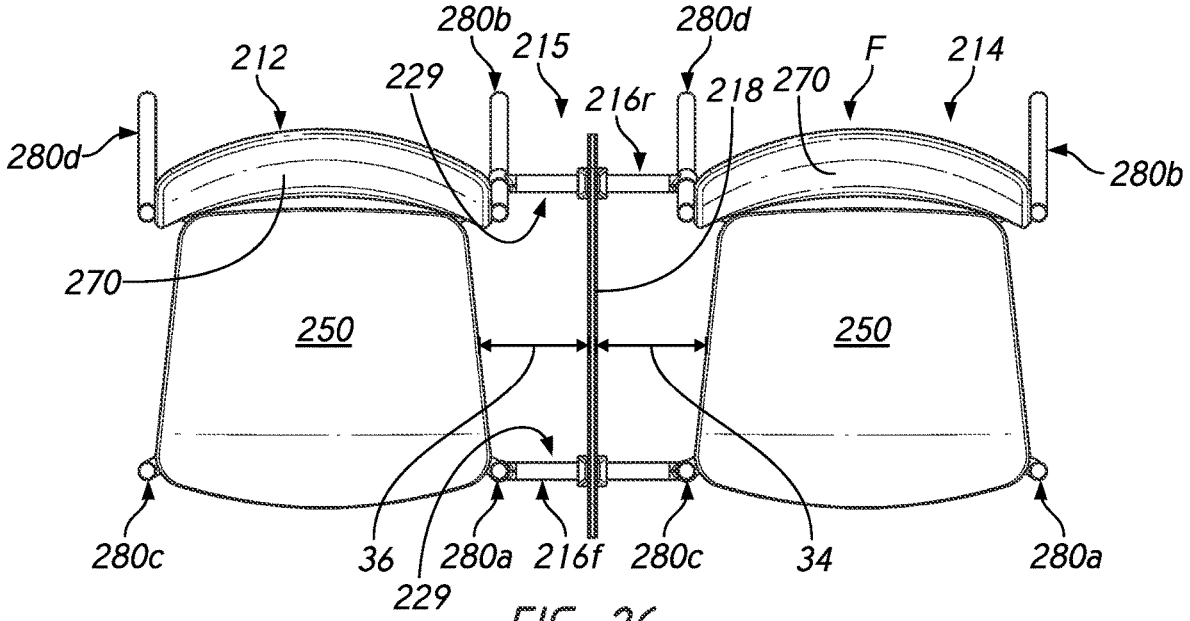
FIG. 26 is a top plan view of the embodiment of FIG. 15.

FIGS. 24-26 include additional views of the ganging assembly 215 connecting together the two chairs 212, 214 to form the ganged assembly 210.

With reference to FIG. 26, if a forward or rearward force F were applied to one of the chairs, for example, chair 214, the force F would tend to cause a racking movement of the chairs 212, 214. A racking movement is known a movement in which one of two connected members moves relative to another and connecting members structural components connecting the two are tilted. Thus, if the chair 214 were pushed forward, such a movement would tend to cause the chair 214 to move forward and thus twist the collar portions 225 relative to the legs 280 to which they are attached. However, because the collar portions 225 of the rear ganger bracket 216*r* are inclined relative to the front granger bracket 216*f*, the racking movement would be better resisted due to the misalignment of the collar portions 225. As such, the central portions 229 would be loaded in torsion in response to a racking force F. This can be an additional benefit by attaching the rear ganging bracket 216*f* to an inclined portion of the legs 280*b*, 280*d*. For example, it prevents all of the racking forces from being exerted onto the friction between the inner surface of the collar portion 225 and the outer surfaces of the legs 280. Generating a sufficiently high friction force between those surface for resisting racking movements can require large clamping surfaces. Thus, connecting at least one of the ganging brackets 216*f*, 216*r*, to legs that are not aligned, can provide an additional benefit.

Figure 27:
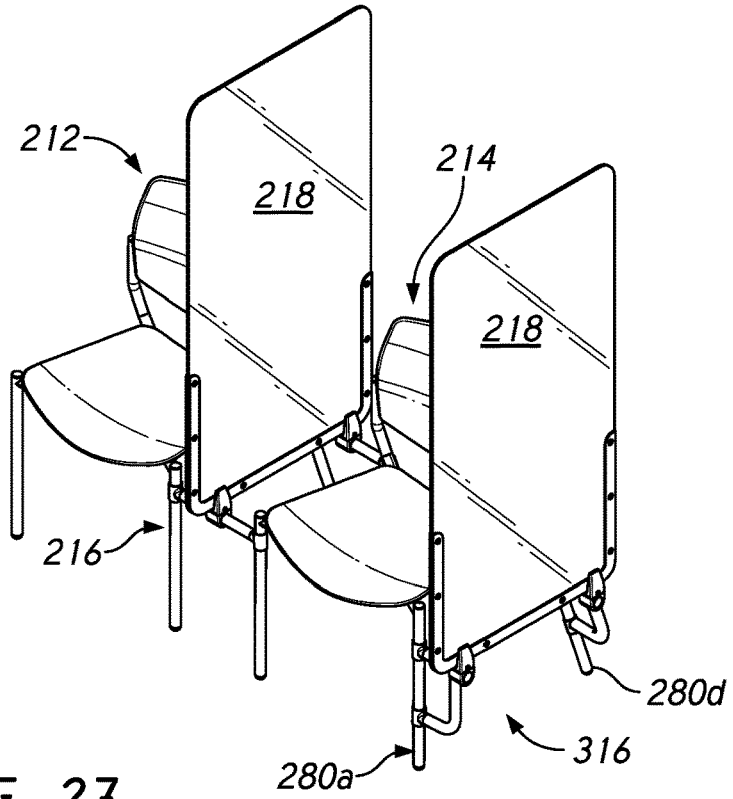
FIG. 27 is a top, front, and left-side perspective view of another embodiment of a furniture-mounted interpersonal shield.
Figure 28:
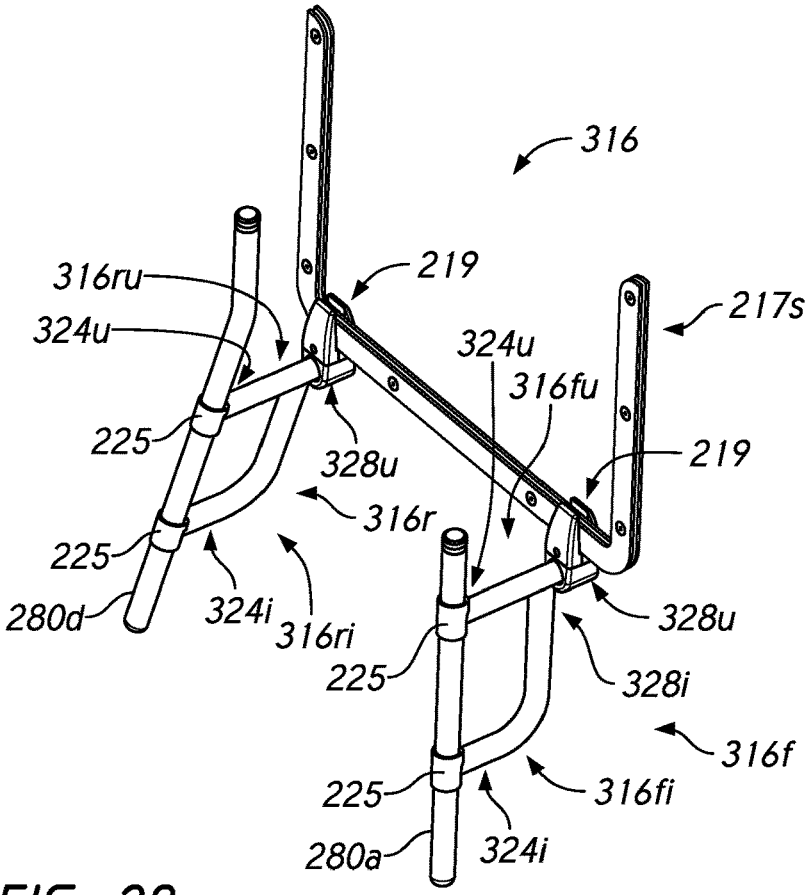
FIG. 28 is an enlarged, front, top, and right-side perspective view of an interpersonal shield support for furniture.

FIGS. 27-28 illustrate another embodiment of the bracket assembly 216, identified generally by the reference numeral 316. Parts, components, and features of the bracket assembly 316 that are the same as or similar to parts, features, components and benefits of the bracket assembly 216 are identified with the same reference numeral except that "100" has been added thereto.

With reference to FIG. 27, the bracket assembly 316 can be configured to support the interpersonal shield 218 relative to a piece of furniture, such as the chair 214. The furniture to which the bracket 316 is attached can be an individual, free-standing piece of furniture or can be connected or ganged with other pieces of furniture such as illustrated in FIG. 27 in which the chair 214 is ganged with the chair 212. Other configurations can also be used.

In the context of the embodiment of FIGS. 27-28, the bracket 316 supports the interpersonal shield 218 in a cantilevered manner, secured to a side of the chair 214. In the illustrated embodiment, the bracket 316 attaches the interpersonal shield 218 to the front and rear legs 280*a*, 280*d* of the chair 214. However, other connecting locations on the chair 214 can also be used.

With reference to FIG. 28, the bracket 316 can include a front bracket assembly 316*f* and a rear bracket assembly 316*r*. The front bracket 316*f* can include an upper bracket portion 316*fu* and a lower bracket portion 316*fl*. The upper bracket portion 316*fu* can include a first end 324*u* attached to the leg 280*a* and a second end 328*u*.

The lower bracket portion 316*fl* can include a first end 324*l* attached to the chair leg 288. The lower bracket portion 316*fl* can also include a second end 328*l*. The second end 328*l* can be attached to the upper bracket portion 316*fu*, for example, by way of a T-joint which can be accomplished by welding, bonding, or other types of attachment techniques or fasteners. The first ends 324*u*, 324*l* can be attached to the chair leg 280*a* with collar assemblies 225, described above. The second end 328*u* of the upper bracket portion 316*fu* can include an interpersonal shield mount 219 (described above) mounted thereon.

Similarly, the rear bracket 316*r* can include an upper portion 316*ru* and a lower portion 316*r*1. The first ends 324*u*, 324*l* of the upper and lower portions can be attached to the rear leg 280*d* with collar assemblies 225. The second end 328*u* of the upper bracket portion 316*ru* can also include an interpersonal shield mount 219.

The interpersonal shield mount 219 can be attached to the interpersonal shield 218 directly and/or by way of the reinforcement assembly 217*s*.

In such a configuration, the interpersonal shield 218 can be attached to a single piece of furniture, in the illustrated embodiment, the chair 214. In such a configuration, optionally, the bracket 316 can support the interpersonal shield 218 in the same or approximately the same orientation and position relative to the parts of the chair 214 and 212 described above with reference to FIGS. 1, 2, 12, 13, and 24-26.

While certain embodiments have been presented in the foregoing detailed description, it should be appreciated that a vast number of variations exist. It should also be appreciated that the embodiments described herein are not intended to limit the scope, applicability, or configuration of the claimed subject matter in any way. Rather, the foregoing detailed description will provide those skilled in the art with a convenient road map for implementing the described embodiments. It should be understood that various changes can be made in the function and arrangement of elements without departing from the scope defined by the claims, which includes known equivalents and foreseeable equivalents at the time of filing this patent application.

What is claimed is:

1. A ganged chair assembly with an integrated interpersonal shield, the ganged chair assembly comprising:

a first chair comprising a first seat member having a first upper seating surface, a first backrest member having a first forward-facing backrest surface, and a first plurality of legs configured to support the first seat member and the first backrest member above a floor surface, in use, the first chair having a left a side;

a second chair comprising a second seat member having a second upper seating surface, a second backrest member having a second forward-facing backrest surface, and a second plurality of legs configured to support the second seat member and the second backrest member above the floor surface, in use, the second chair having a right side;

a first ganger bracket comprising a first end portion connected to the left side of the first chair and a second end portion connected to the right side of the second chair;

a second ganger bracket comprising a first end portion connected to the left side of the first chair at a location spaced from the first end of the first ganger bracket and a second end portion connected to the right side of the second chair at a location spaced from the second end of the first ganger bracket, wherein the first and second ganger brackets are sized to laterally space the first and second upper seating surfaces apart by at least about six inches;

a first interpersonal shield support block mounted to the first ganger bracket;

a second interpersonal shield support block mounted to the second ganger bracket;

an interpersonal shield member supported by the first and second interpersonal shield support blocks at a position about halfway between the first and second upper seating surfaces, the interpersonal shield member comprising:

a rigid material that is at least substantially transparent;

a lower end connected to the first and second interpersonal shield support blocks;

an upper edge portion extending to a height of at least about two feet higher than the first and second upper seating surfaces of the first and second chairs;

a rear edge portion disposed rearwardly from the first and second forward-facing backrest surfaces; and a front edge portion disposed at least about twelve inches forward from the first and second forward-facing backrest surfaces;

wherein the interpersonal shield defines an obstacle to flows of gases containing biological fluids exhaled by first and second users seated on the first and second chairs, respectively, in use.

2. The ganged chair assembly according to claim 1 additionally comprising a reinforcement bracket fixed to the lower end of the interpersonal shield member and secured to the first and second interpersonal shield support blocks.

3. The ganged chair assembly according to claim 1, wherein the first ends of the first and second ganger brackets are connected to the first plurality of legs and the second ends of the first and second ganger brackets are connected to the second plurality of legs.

4. The ganged chair assembly according to claim 1, wherein interpersonal shield member is spaced from the first and second upper seating surfaces and from the first and second forward-facing backrest surfaces.

5. A chair ganging bracket assembly with integrated interpersonal shield, the chair ganging bracket assembly comprising:

a first ganger bracket portion comprising a first end portion configured to be connectable a left side of a first chair and a second end portion configured to be connectable to a right side of a second chair;

a second ganger bracket portion comprising a first end portion configured to be connectable to the left side of the first chair at a location spaced from the first end portion of the first ganger bracket portion and a second end portion configured to be connectable connected to the right side of the second chair at a location spaced from the second end portion of the first ganger bracket portion;

a first interpersonal shield support mounted to the first ganger bracket;

a second interpersonal shield support mounted to the second ganger bracket;

an interpersonal shield member supported by the first and second interpersonal shield supports, the interpersonal shield member comprising:

a rigid material that is at least substantially transparent;

a lower end connected to the first and second interpersonal shield supports;

an upper edge portion extending to a height of at least about two feet above the lower end;

a rear edge portion; and a front edge portion disposed forwardly from the rear edge portion;

wherein the interpersonal shield defines an obstacle to flows of gases containing biological fluids exhaled by first and second users seated on the first and second chairs, respectively, in use.

6. The chair ganging bracket assembly with integrated interpersonal shield according to claim 5 additionally comprising a reinforcement bracket fixed to the lower end of the interpersonal shield member and secured to the first and second interpersonal shield support blocks.

7. The chair ganging bracket assembly with integrated interpersonal shield according to claim 5, wherein the first ends of the first and second ganger bracket portions are connected to a first plurality of legs and the second ends of the first and second ganger bracket portions are connected to a second plurality of legs.

8. The chair ganging bracket assembly with integrated interpersonal shield according to claim 5, wherein the first and second ganger bracket portions are configured to support the interpersonal shield member spaced from first and second upper seating surfaces and from first and second forward-facing backrest surfaces of the first and second chairs.

9. The chair ganging bracket assembly with integrated interpersonal shield according to claim 5, wherein the interpersonal shield member is sized such that the upper edge of the interpersonal shield member is higher than first and second upper seating surfaces of first and second chairs connected to the first and second ganger brackets, in use.

10. The chair ganging bracket assembly with integrated interpersonal shield according to claim 5, wherein the interpersonal shield member is sized such that the rear edge portion is disposed rearwardly from first and second forward-facing backrest surfaces of first and second chairs connected to the first and second ganger brackets, in use.

11. The chair ganging bracket assembly with integrated interpersonal shield according to claim 5, wherein the interpersonal shield member is sized such that the front edge portion disposed at least about six inches forwardly from first and second forward-facing backrest surfaces of first and second chairs connected to the first and second ganger bracket portions, in use.

12. The chair ganging bracket assembly with integrated interpersonal shield according to claim 5, in combination with a first chair comprising a first seat member having a first upper seating surface, a first backrest member having a first forward-facing backrest surface, and a first plurality of legs configured to support the first seat member above a floor surface, in use, the first chair having a left a side and a second chair comprising a second seat member having a second upper seating surface, a second backrest member having a second forward-facing backrest surface, and a second plurality of legs configured to support the second seat member above the floor surface, in use, the second chair having a right side, wherein the first ends of the first and second ganger bracket portions are connected to the left side of the first chair and the second ends of the first and second ganger bracket portions are connected to the right side of the second chair.

13. The chair ganging bracket assembly with integrated interpersonal shield according to claim 5, wherein the first and second ganger bracket portions are sized to laterally space first and second chairs apart by at least about six inches, in use.

14. The chair ganging bracket assembly with integrated interpersonal shield according to claim 5, wherein the first and second interpersonal shield supports are disposed at a position about halfway between the first and second chairs, in use.

15. An assembly for attaching an interpersonal shield to a piece of furniture, comprising:

a bracket assembly comprising a first end portion configured to be connectable a side of a first piece of furniture having a seating surface, and an interpersonal shield support configured to secure an interpersonal shield in an upright orientation and adjacent to and extending higher than the seating surface of the first piece of furniture, in use.

16. The assembly according to claim 15 additionally comprising an interpersonal shield member supported by the interpersonal shield support, the interpersonal shield member comprising a lower end connected to the interpersonal shield support, an upper edge portion extending to a height of at least about two feet above the lower end, a rear edge portion, and a front edge portion disposed forwardly from the rear edge portion, wherein the interpersonal shield defines an obstacle to flows of exhaled gases containing biological fluids.

17. The assembly according to claim 16, wherein the interpersonal shield comprises a rigid material that is at least substantially transparent.

18. The assembly according to claim 15, wherein the bracket assembly comprises a first end portion configured to be connectable to the left side of the first piece of furniture and a second end portion configured to be connectable connected to a right side of second piece of furniture.

19. The assembly according to claim 18 additionally comprising a second interpersonal shield support mounted to the bracket assembly.

20. The assembly according to claim 16 additionally comprising a reinforcement bracket fixed to the lower end of the interpersonal shield member and secured to the interpersonal shield support.

21. The assembly according to claim 15, wherein the first end portion of the bracket assembly is configured to be connected to a plurality of legs of the first piece of furniture and a second end portion of the bracket assembly is configured to be connected to a plurality of legs of a second piece of furniture, in use.

22. The assembly according to claim 15, wherein the bracket assembly is sized so as to support an interpersonal shield member in a position spaced from a seating surface and a backrest surface of the first piece of furniture, in use.

23. The assembly according to claim 15, wherein bracket assembly is sized so as to support an interpersonal shield member in a position in which an upper edge portion of the interpersonal shield member is at least twelve inches higher than a seating surface of the first piece of furniture, in use.

* * * * *